US008967323B1

(12) United States Patent
Grenier

(10) Patent No.: US 8,967,323 B1
(45) Date of Patent: Mar. 3, 2015

(54) MULTI-DIRECTIONAL FOLDBACK AND FRONT OF HOUSE SPEAKER ENCLOSURE

(71) Applicant: James Robert Grenier, Salisbury, MA (US)

(72) Inventor: James Robert Grenier, Salisbury, MA (US)

( * ) Notice: Subject to any disclaimer, the term of this patent is extended or adjusted under 35 U.S.C. 154(b) by 0 days.

(21) Appl. No.: 14/095,522

(22) Filed: Dec. 3, 2013

Related U.S. Application Data

(60) Provisional application No. 61/746,510, filed on Dec. 27, 2012.

(51) Int. Cl.
*A47B 81/06* (2006.01)
*H04R 1/02* (2006.01)

(52) U.S. Cl.
CPC ..... *H04R 1/02* (2013.01)
USPC ..... 181/199; 181/198

(58) Field of Classification Search
CPC ..... H04R 1/02
USPC ..... 181/199, 198
See application file for complete search history.

(56) References Cited

U.S. PATENT DOCUMENTS

| | | | | | |
|---|---|---|---|---|---|
| D225,865 | S | | 1/1973 | Sjostedt | |
| 4,475,620 | A | * | 10/1984 | Carlsson | 181/146 |
| 4,558,762 | A | * | 12/1985 | Carlsson | 181/147 |
| 4,730,694 | A | * | 3/1988 | Albarino | 181/153 |
| 4,773,502 | A | * | 9/1988 | Adair | 181/149 |
| 4,881,265 | A | | 11/1989 | Gala, Jr. | |
| D307,014 | S | * | 4/1990 | Newman | D14/210 |
| 5,436,976 | A | | 7/1995 | Dougherty | |
| 5,696,357 | A | * | 12/1997 | Starobin | 181/156 |
| D434,750 | S | | 12/2000 | Childers | |
| D578,510 | S | | 10/2008 | Tanaka | |
| D592,642 | S | | 5/2009 | Andrews | |
| D626,938 | S | | 11/2010 | Moore | |
| 7,967,104 | B2 | * | 6/2011 | Carter | 181/199 |
| D689,040 | S | | 9/2013 | Calhoun | |
| 2008/0085022 | A1 | | 4/2008 | Polster | |

OTHER PUBLICATIONS

Cubedge®, *Edge•Sound User Guide* http://www.cubedge.com/EDGE.sound_manual_English.pdf © 2012 Cubedge®.

* cited by examiner

*Primary Examiner* — Forrest M Phillips

(57) ABSTRACT

The enclosure comprises a seven-sided prism on which loudspeakers or other devices for sound reproduction are mounted at a substantial angle to each other. Using its primary base, speakers are angled obliquely upward. Speakers mounted on the enclosure can share a single audio signal. Multiple signals can be sent to speakers on different sides of the enclosure. It can be used as a double floor monitor, a wide-dispersion main speaker, a simultaneous combination of double floor monitor and audience-facing main speaker, or a combination of wide dispersion main speaker and a single floor monitor. It reduces the number of speaker enclosures necessary for a stage production. It can be manufactured simply and affordably from many materials using standard construction methods. The enclosure may be useful for any other application where it may be advantageous, including but not limited to, audio speakers for computer, television, radio, or music playback.

12 Claims, 16 Drawing Sheets

MULTI-DIRECTIONAL FOLDBACK AND FRONT OF HOUSE SPEAKER ENCLOSURE

CROSS-REFERENCE TO RELATED APPLICATIONS

This application claims benefit of provisional patent application Ser. No. 61/746,510, filed 2012 Dec. 27 by the present inventor.

BACKGROUND

This application relates to speaker enclosures, particularly to floor monitors

REFERENCES

The following is a tabulation of some published references which presently appear relevant:

U.S. Patents

| Pat. No. | Kind Code | Issue Date | Patentee |
|---|---|---|---|
| D689040 | S1 | Sep. 3, 2013 | Calhoun |
| 5436976 | A | Jul. 25, 1995 | Dougherty |
| D578510 | S | Oct. 14, 2008 | Tanaka |
| 4881265 | A | Sep. 13, 1989 | Gala, Jr. |
| D626938 | S | Nov. 9, 2010 | Moore |
| D307014 | S | Apr. 3, 1990 | Newman |
| D592642 | S | May 19, 2009 | Andrews |
| D225865 | S | Feb. 22, 1971 | Sjostedt |
| D434750 | S | May 24, 2000 | Childers |
| 4,475,620 | A | Oct. 9, 1984 | Carlsson |

U.S. Patent Application Publications

| Publication Number | Kind Code | Publ. Date | Applicant |
|---|---|---|---|
| 2008/0085022 | A1 | Oct. 4, 2008 | Polster |

NONPATENT LITERATURE DOCUMENTS

Cubedge®, *Edge.Sound User Guide* http://www.cubedge.com/EDGE.sound_manual_English.pdf © 2012 Cubedge®

Groove Audio™, BlueSYNC_EDG_USER_GUIDE_ml.pdf

GuangDong GRS Technology Co., Ltd., *Product Show—Guangdong GRS Technology Co., Ltd. pdf.* See also web URL http://www.grs-audio.com/en/ArticleShow.asp?ArticleID=174.

Floor monitors, also called stage monitors, are speaker enclosures used in stage productions to allow performers to hear their performances. The common term used by sound engineers for any monitor that faces inwardly towards a performer on the stage is called a foldback. As shown as prior art in the drawings, they work by resting on the floor with a speaker or groups of speakers and/or openings or ports aimed upward to some degree towards the performer. They may contain devices for sound reproduction such as a single loudspeaker or a group of loudspeaker types including woofers, tweeters, horns, piezos and ports and openings. The enclosure is placed in such a way as to help prevent feedback from a microphone used by the performer. The upward direction of the devices for sound reproduction in a monitor help keep the sound axis more in line with the usual axis of the performer's microphone. When many performers are on stage it is often necessary to have multiple floor monitors so each performer can hear themselves as they perform.

In addition to floor monitors, many performances require a conventional main speaker be placed facing the audience. These types of speakers are also referred to by sound engineers as front of house. Main speakers are often placed to the right and/or left side of the stage, away from and usually forward of the performer(s) in order to reduce the possibility of feedback. This can add more equipment to the stage space. The more floor monitors and main speakers required, the less space is left for the performers. On small stages in venues where performance space is limited, this poses a significant problem.

Performers and performing groups often must provide their own sound systems. Speaker enclosures are often the largest items needed. Transportation of conventional speaker enclosures can be a problem because the more enclosures needed, the larger the transportation vehicle must be.

Most conventional floor monitors today are a variation on a cuboid with a truncated edge where the plane created by the truncation serves as its primary base. Another conventional floor monitor enclosure is a triangular prism where one panel of the enclosure is used as a base and one panel has a device or devices for sound reproduction. Representational examples can be seen in the application drawings.

The reasons for the cuboid as a basis for a speaker enclosures are based primarily in the ease of and economy of manufacture, and the ease and efficiency of stacking and storage. The best speaker enclosures for sound quality and ruggedness are of birch plywood, but the most economical for mass production is of moulded plastic. It should be obvious to the reader that the more complex a speaker enclosure becomes the more expensive it becomes to manufacture and the more expensive for a consumer to purchase.

Some speaker enclosures have devices for sound reproduction on more than one side such as described in Calhoun, Dougherty, Tanaka and others referenced. This is also shown in the nonpatent literature document for the GuangDong GRS Technology CS212 KTV speaker represented in the drawings. These speaker enclosures allow for a wide dispersion of sound or multiple areas of sound. Most referenced enclosures are not intended for use as double floor monitors, nor would they be successful unless used with some kind of mechanism to tilt them at an upwards angle.

In U.S. Design Pat. No. D689040, Calhoun shows an ornamental design for an enclosure which is a fully truncated three-sided pyramid having a total of 6 sides. The design shows speakers mounted on two panels and a bottom panel. The panels holding speakers are hexagonal and there is a speaker mounted on the base. No planes created by the multiple corner truncations are indicated as a base and even if any were, it would not alter the angle of the speaker panels to the floor in any substantial way.

In U.S. Pat. No. 5,436,976, Dougherty shows an omnidirectional speaker enclosure based on a tetrahedron. Dougherty's enclosure is intended for suspension inside a spherical outer housing and is suspended from above or mounted on a pole from below. Dougherty also shows a cube with a loudspeaker mounted on all six sides. It may be possible for Dougherty's tetrahedron enclosure to work as a double floor monitor and even as a multiple-axis speaker enclosure. Yet the intention and design of Dougherty's enclosure is to produce spheroidal projected sound from a single sound signal. The geometry of Dougherty's enclosure is substantially different from my enclosure and does not disclose the flexibily of use as shown in my drawings and description.

In U.S. Design Pat. No. D578510, Tanaka shows an ornamental design for a speaker enclosure with speakers on three sides of what might be termed a single corner truncated non-symetrical square-based pyramid. Two sides are angled obliquely to the base which is substantially rectangular. Two of the panels holding a device for sound reproduction are oblique to the base and at two different angles, allowing the enclosure to possibly be used as a double monitor. There is no corner truncation shown to be used as a base.

In U.S. Pat. No. 4,881,265, Gala shows two intersecting panels with speakers and tweeters. The enclosure is shown to be a seven-sided prism with pentagonal top and bottom. Gala's description indicate the enclosure is a tower configuration. Gala indicates a preference for the enclosure to have a pentangle base and top, though Gala also suggests a triangular shape for a base and top. There could be a method for this enclosure to be used as a double floor monitor by placing the enclosure on the side opposite the intersection of the panels where the devices for sound reproduction are mounted. However, the enclosure would need to be placed between the performers and the microphones as well, resulting in the performers facing each other and not the audience, an unconventional situation on stage. Gala's enclosure could serve as a combination single floor monitor and an audience-facing main speaker if placed between the performers and the audience.

In U.S. Design Pat. No. D626938, Moore shows an ornamental design for a speaker enclosure of complex geometry where the panel holding devices for sound reproduction is at a slight oblique angle to the base. Moore does not demonstrate that multiple panels can hold speakers nor is the enclosure base a corner truncation. The design lacks the versatility and simplicity of my enclosure.

In U.S. Design Pat. No. D307014, Newman shows an ornamental speaker enclosure with three panels to hold speakers. The top view demonstrates, like Gala, the enclosure is primarily a pentagonal prism with a truncated corner. Newman utilizes the panel created by the plane of the truncation to hold a speaker rather than as primary base. Newman's enclosure presents all indicated speakers in the same general direction simply widening the dispersion field by varying the angle of the speakers. This design does not lend itself well to use as a double floor monitor because the angles of the speaker panels are not substantial enough to produce effective separate sound signals and would allow separate signals to overlap. It is also ineffective as a floor monitor because it would require the aid of other devices to hold the speakers at an oblique angle to the floor.

In U.S. Design Pat. No. D592642, Andrews shows ornamental designs for several embodiments of an ornamental speaker enclosure presenting angled speakers. This enclosure is a cuboid with recessed panels intersecting at an angle to one another to produce either an increase in sound dispersion or possibly stereo signals. In order for the sound to avoid being blocked by a solid enclosure panel, recesses on the sides have been created. The shape of the enclosure would require a separate device to raise the front enough so it could be used as a floor monitor. In addition, the angles of the speaker panels are not substantial enough to produce effective separate sound signals and would allow separate signals to overlap. If modified to be used as a floor monitor with even a mono signal, the angle of the speakers would provide an inconsequential advantage over other conventional floor monitors.

In U.S. Design Pat. No. D225865, Sjostedt shows an ornamental design for an eight-sided speaker enclosure with no apparent base. Each panel appears to act as a decorative cover for a device or devices for sound reproduction. It is unclear if each panel has devices for sound reproduction mounted on it. This enclosure is designed so as to project sound in eight directions causing an omni-directional field of sound, much as does Dougherty, above. This design might be practical as a main speaker if suspended or otherwise raised to take advantage of all apparent speaker panels but would be impractical as a floor monitor.

In U.S. Design Pat. No. D434750, Childers shows an ornamental design of a speaker enclosure based on a cuboid with an edge truncation. The manner in which Childers has situated the panels holding speakers shows it is conceivable the enclosure, when used where its right side is a base, the speakers on the panel created by the truncation could be aimed obliquely upward from the base and used as a floor monitor. This would in turn present the devices for sound reproduction on the front panel to be audience-facing. In this way, the enclosure could be simultaneously used as a single floor monitor and an audience-facing main speaker. However, it cannot be used as a double floor monitor.

In U.S. Patent Application 2008/0085022, Pollster shows enclosures with speakers mounted on two intersecting panels. The drawings show a trapezoidal prism. The drawings indicate the intention of a right speaker enclosure and a left speaker enclosure. The drawings demonstrate these enclosures being used as combination performer-facing monitors and audience-facing main speakers. There is no indication these enclosure can be used as a double floor monitor and describes no way to modify them to do so. There is no truncated corner which can act as a base.

In U.S. Pat. No. 4,475,620 Carlsson FIG. 1 shows a parallelepiped with a single corner truncation. The art also shows the resulting triangular panel is not a primary base, or secondary base of any kind. The geometry of Carlsson FIGS. 1-3 is physically different in that it is comprised of four triangle panels and three rectangular panels, unlike my design of three four-sided panels, three four-sided panels and one three-sided panel. Carlsson's enclosure's primary base is a four-sided panel, regardless if it were to be place on a wall or a floor. The triangular panel created through Carlsson's truncation is used to mount speakers, which would render its use as a base unlikely.

The embodiment Carlsson's FIG. 4 in the above patent is of different geometry from Carlsson's FIGS. 1-3, it being a parallelepiped with an external triangular panel mounted to one side in order hold a speaker at an upward angle. One other panel is also shown to hold a speaker which is not positioned in a separate direction from the speaker mounted on the triangular panel, but instead is mounted externally on top of the panel shown to be directed in the same general direction as that mounted on the triangular panel. The top-mounted horn device shown in the FIG. 4 embodiment adds an externally-mounted speaker on a second panel as well as a sound absorbing panel, both items adding to the devices complexity.

All Carlsson's Figs. in the above patent show enclosures intended to be specifically positioned on or near a wall and all rely on an external or added-on wall reflex absorber as a fundamental element to the function and use of the enclosure. Carlsson's art addresses a device designed to reduce "disturbances due to the reflected sound from the wall behind the loudspeaker." and not towards any other purpose. No evidence is given by Carlsson that this invention is intended to be used as, or could be adapted to, any other purpose.

My enclosure has both different geometry and function. In addition, my enclosure introduces a new use as a combination floor monitor/main speaker—a use not anticipated by Carlsson. Though it may be possible to use the Carlsson enclosure as a floor monitor as shown, it would only allow one panel to be directed upward to a performer. By adding internal speakers to other panels would render them at 90° to the floor, thus being very inefficient for this purpose.

In the Nonpatent Literature Document Cubedge®, *Edge. Sound User Guide*, the prior art speaker enclosure called the EDGE.Sound displays a single truncated corner on a cuboid. Unlike my enclosure, this product's truncation is used primarily to house an indicator light. Its design does not show it was intended to be used successfully as a base. This enclosure also only demonstrates devices for sound reproduction on a single side. I have also included an example in the drawings.

In the Nonpatent Literature Document *BlueSYNC_EDG_USER_GUIDE_ml.pdf,* the prior art speaker enclosure called the GOgroove BLUESYNC EDG displays a single truncated corner on a cuboid. The attached document demonstrates this enclosure employing a corner truncation as a primary base. The truncation, however, is used in such away as to present a single speaker at an upward angle, rather than multiple speakers on multiple panels aimed in multiple directions. A drawing of this enclosure is included in the drawings.

In the Nonpatent Literature Document *Product Show—Guangdong GRS Technology Co., Ltd.pdf*, speakers are shown on two adjoining panels of the KTV enclosure. This feature allows one set of speakers on the longer side to be presented to an audience while speakers on the shorter side can be aimed as a side-fill monitor towards a performer, allowing the audience and performer to hear the performance from a single enclosure. However, the use of this enclosure is limited to these functions only and shows no truncation of side or corner in which to present either set of speakers at an upward angle as is necessary for a floor monitor. I have also included an example in the drawings.

Conventional floor monitors use a mono signal because they are used for a single sound field. This means that not only do performers on different areas of a stage need separate floor monitors they also typically listen to the same sound signal. For a plurality of sound signals to be used with conventional monitors, a plurality of floor monitors are used.

Many floor monitors are designed to double as a main speaker by placing the enclosure on a secondary base. Often this secondary base includes an attached pole mount for placing the enclosure on a pole in order to raise it to a more optimum level for broadcasting the sound towards an audience.

As can be seen from the references above, no previous enclosure has addressed the need for a simple and easily manufactured floor monitor which can be used to deliver multiple signals in multiple directions. It is doubtful the designers of these enclosures have even considered the problem which is solved by my enclosure. As explained above, not a single previous enclosure is capable of solving the problem I have addressed and solved with my enclosure.

SUMMARY

Most conventional speaker enclosures have devices for sound reproduction on only one panel, though there are examples of those which have them on two or more panels such as have been previously discussed. Conventional floor monitors have devices for sound reproduction on only a single panel and are usually based on a rectangular prism or cuboid with a truncation along one edge where two sides might normally intersect. The plane formed by the truncation provides the primary base so as to present the speakers in an upward angle to a performer. Another conventional floor monitor design is of a triangular prism. A secondary base which presents the devices for sound reproduction perpendicular to the floor's horizontal surface is sometimes employed if the floor monitor is also to be used as a main speaker.

Other speaker enclosures of unconventional design do demonstrate speakers on multiple panels but none of these, as shown, are designed as practical floor monitors nor do they solve the problems cited as thoroughly as my enclosure.

Advantages

The advantage of my novel enclosure is that it solves the above problems by combining the capabilities of multiple conventional speaker enclosures in a single compact unit. My enclosure allows separate sound signals or mixes to be sent to different devices of sound reproduction providing performers with unique signals, mixes and volumes. It serves the place of two conventional floor monitors while maintaining a small footprint.

A second embodiment of the enclosure provides a third panel to hold an additional speaker or a group of speakers. When the second embodiment enclosure is placed on its primary base, the speaker on the third panel is directed outward and upward from the stage towards an audience, reducing the need for other main speakers.

When used with the secondary base, at least one embodiment of this enclosure can also act as a wide-dispersion main speaker or as double main speaker depending on the dispersion and mounting of the predetermined devices of sound reproduction.

This enclosure is economical to build, allows more flexibility in use than conventional products, replaces multiple conventional products, is simple, compact, unique and attractive in design.

Other objects and advantages of the invention will become apparent upon reading the detailed description, appending claims, and reference to the accompanying drawings.

DRAWINGS

Figures

DRAWINGS

Reference Numbers

Figure 1:
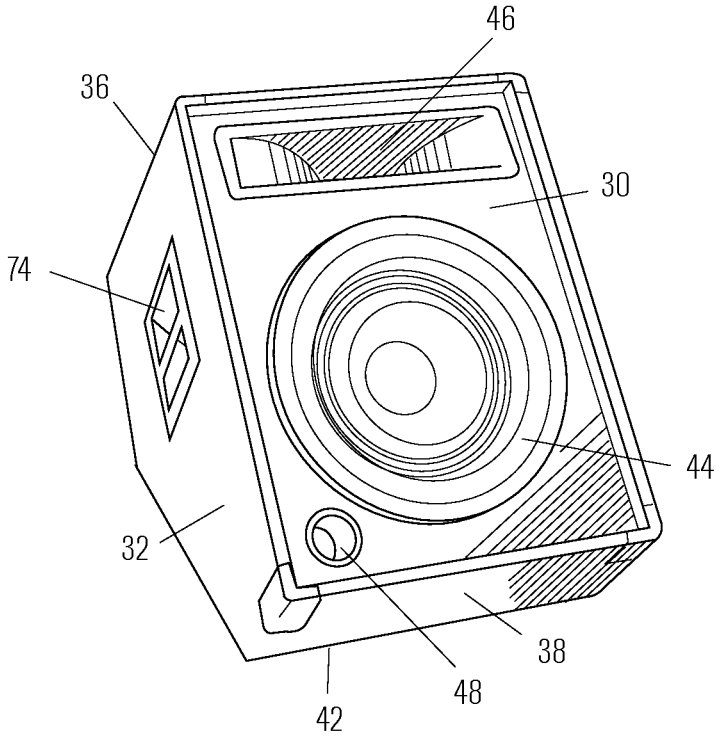
FIG. 1 PRIOR ART
FIG. 1 is prior art: a drawing of a conventional floor monitor.

30 first panel
32 second panel
34 third panel
36 fourth panel or secondary base
38 fifth panel
40 sixth panel
42 seventh panel or primary base
44 loudspeaker or plurality of loudspeakers
46 high frequency speaker
48 port tube or port opening
50 general direction of sound
52 general cone of sound dispersion
54 volume control
56 jack plate
58 audio signal input and/or audio signal output
60 first audio signal
62 second audio signal
64 third audio signal
65 fourth audio signal
66 pole mount socket
68 pole mount flange
70 cabinet corner
72 feet or cushions
74 handle
76 fastener such as a screw or bolt
78 light
80 audio amplifier
82 internal baffle structure
84 acoustic sound dampening foam
86 sound absorbing material
90 audio signal cable
92 brace or bracing
94 protective grill cover
96 top molded section
98 bottom molded section
100 enclosure with two speakers: first panel and second panel
102 enclosure with three speakers: first panel, second panel and third panel
104 performer
106 audience or audience area
108 stage
110 floor
112 pole or speaker stand
114 microphone
116 microphone cable
118 wireless receiver (i.e. Bluetooth®, UHF or VHF)
120 power on/off
124 mono input
126 mono output
128 stereo input
132 logo, graphic or indicia

DESCRIPTION

Units of audio drivers such as but not limited to woofers, tweeters, horns, and piezos, and port openings or port tubes alone or in combination are referred to within the descriptions as devices for sound reproduction and constitute a means for sound reproduction.

Similarly, the types of materials, construction methods, fasteners which may be employed in the manufacture of any embodiment of the enclosure are also broad. Materials can be of nearly anything provided it is sufficiently rigid. Construction methods can include any method capable of creating a rigid box and are too numerous to list, but may include wood and plywood construction, fiberglass and resin, vacuum-forming, and injection molding as common methods. Fasteners can include but are not limited to threaded fasteners such as nuts and bolts or screws, adhesives and epoxies, rivets, soldering or welding, or nails.

The applicant intends to encompass within the language any structure, device, fastener, material or method of construction presently existing or developed in the future which performs the same function.

DETAILED DESCRIPTION

FIGS. 1-6—Prior Art

Figure 2:
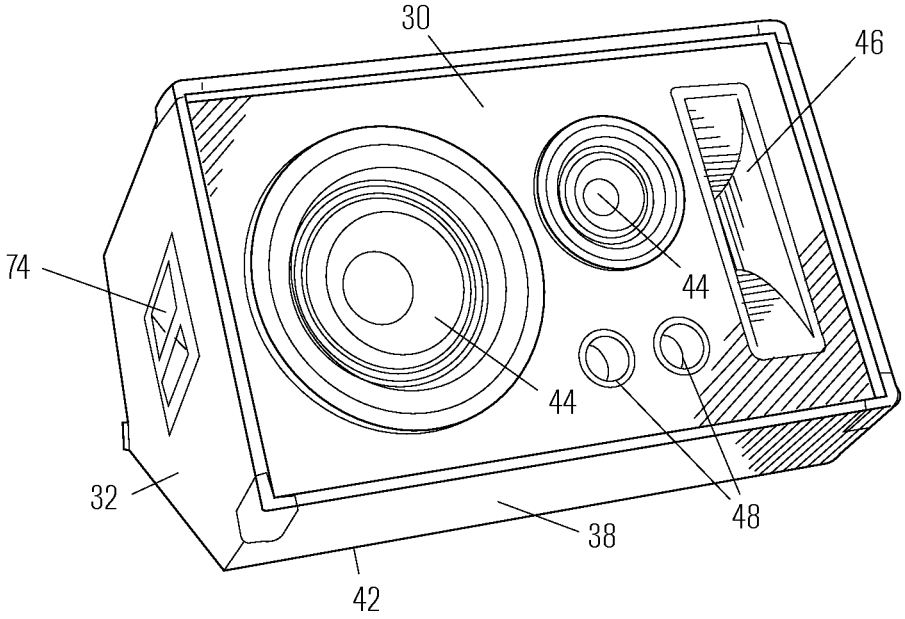
FIG. 2 PRIOR ART
FIG. 2 is prior art: a drawing of a conventional floor monitor.
Figure 3:
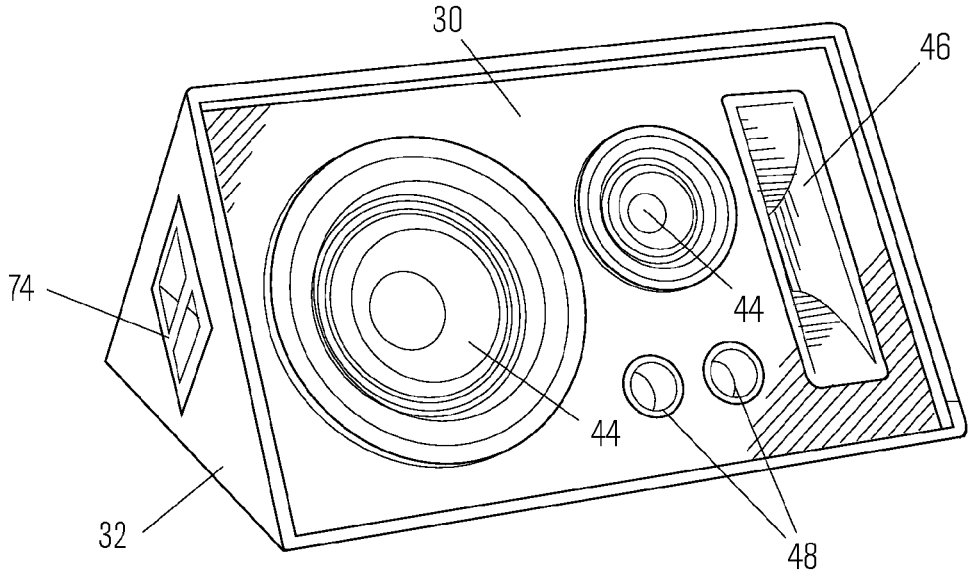
FIG. 3 PRIOR ART
FIG. 3 is prior art: a drawing of a conventional wedge floor monitor.
Figure 4:
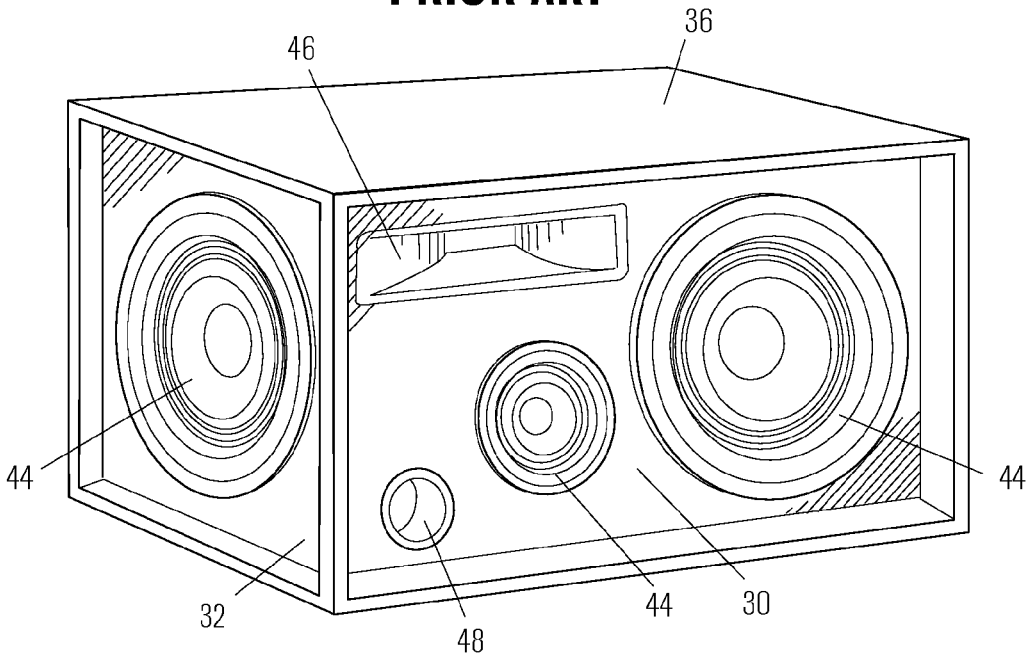
FIG. 4 PRIOR ART
FIG. 4 is prior art: a drawing of a karaoke television system (KTV) speaker.
Figure 5:
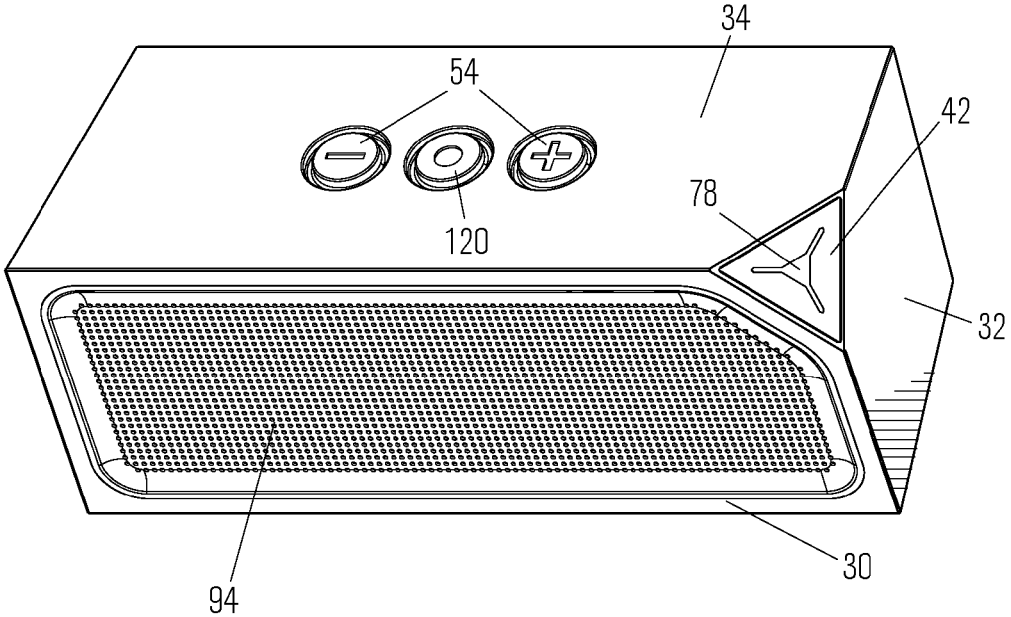
FIG. 5 PRIOR ART
FIG. 5 is prior art: a drawing of the Cubedge® Portable Bluetooth Speaker.

Related prior art is shown as FIG. 1, an embodiment of a conventional floor monitor enclosure; FIG. 2, a second embodiment of a conventional floor monitor enclosure; FIG. 3, a third embodiment of a conventional floor monitor enclosure; FIG. 4, a karaoke television speaker enclosure; FIG. 5, the Cubedge® Portable Bluetooth Speaker manufactured by Cubedge, Inc.; and FIG. 6, the GOgroove BLUESYNC EDG.

FIG. 1 is Prior Art showing a perspective view of an embodiment of a conventional floor monitor enclosure which are manufactured by many speaker enclosure companies. The enclosure is typically a rectangular prism with a full edge truncated which acts as a primary base. This truncation is parallel to the shorter of the sides. The second panel (32)

demonstrates this typical shape. The first panel (30) which faces at an angle upwards towards a performer has openings for a loudspeaker (44), a high frequency speaker (46) and optionally a port tube (48) mounted on it.

The loudspeaker (44) and high frequency speaker (46) are connected through an internal frequency crossover inside the enclosure to audio inputs which are connected to a conventional amplifier. In some cases this type of monitor may enclose an internal amplifier and is called a powered floor monitor or an active floor monitor.

Carrying handles (74) are often included. Pole sockets often mounted on a secondary base (36) can be included for mounting to a pole or speaker stand allowing the enclosure to double as a raised main speaker. Because the speakers are situated on only a first panel (30) this type of monitor is limited in its field of sound and is capable of sending sound in only a single general direction. Because it only has a single set of speakers, the speakers are limited to the reproduction of a single mono signal.

FIG. 2 is Prior Art showing a perspective view of a second embodiment of a conventional floor monitor enclosure which are manufactured by many speaker enclosure companies. As in FIG. 1, the enclosure is typically a rectangular prism with a full edge truncated which acts as a primary base. The second panel (32) demonstrates this typical shape. It differs slightly from FIG. 1 as the truncated edge is parallel to the longer sides and presents a more horizontal appearance. The first panel (30) which faces at an angle upwards towards a performer has openings for one or more loudspeakers (44), a high frequency speaker (46) and optionally a port opening or tube or plurality of port openings or tubes (48) mounted on it. The loudspeakers and high frequency speaker are connected through an internal frequency crossover inside the enclosure to audio inputs which are connected to a conventional amplifier. In some cases this type of monitor may enclose an internal amplifier and is called a powered floor monitor or an active floor monitor.

Pole sockets can also be included for mounting to a pole or speaker stand allowing the enclosure to double as a raised main speaker. Carrying handles (74) are often included. Because the speakers are situated on only a first panel (30) this type of monitor is limited in the field of sound and is capable of sending sound in only a single general direction. Because it only has a single set of speakers, the monitor is limited to the reproduction of a single mono signal. When used as a floor monitor this type of conventional monitor also requires more floorspace than one of FIG. 1.

FIG. 3 is Prior Art showing a perspective view of a third embodiment of a conventional floor monitor enclosure which are manufactured by many speaker enclosure companies. The enclosure is a triangular prism with one side which acts as a primary base. The second panel (32) demonstrates this typical shape. The first panel (30) which faces at an angle upwards towards a performer typically has openings for one or more loudspeakers (44), a high frequency speaker (46) and optionally a port opening or tube or plurality of port openings or tubes (48) mounted on it. The loudspeakers and high frequency speaker are connected through an internal frequency crossover inside the enclosure to audio inputs which are connected to a conventional amplifier. In some cases this type of monitor may enclose an internal amplifier and is called a powered wedge monitor, powered floor monitor or an active floor monitor.

Pole sockets can also be included for mounting to a pole or speaker stand allowing the enclosure to double as a raised main speaker. Carrying handles (74) are often included. Because the speakers are situated on only a first panel (30) this type of monitor is limited in the field of sound and is capable of sending sound in only a single general direction. Because it only has a single set of speakers, the monitor is limited to the reproduction of a single mono signal.

FIG. 4 is Prior Art showing a perspective view of an embodiment of a karaoke television (KTV) system speaker. Unlike the conventional floor monitors shown in FIG. 1, FIG. 2, and FIG. 3, this enclosure demonstrates openings for loudspeakers (44) and other devices such as high frequency speakers (46) and port openings or tubes (48) attached to the first panel (30) and an opening for a single loudspeaker (44) on a second panel (32). This arrangement allows the first panel to be positioned so sound coming from its speakers are projected in one general direction such as the direction of an audience, while the sound from speaker mounted on the second panel (32) is directed to a second general direction and can act as a side-fill monitor so a performer or performers can hear themselves as they perform. Unlike FIG. 1 and FIG. 2, this enclosure is not truncated along any edge. No corner is shown to be truncated. In order for it to double as an effective floor monitor, it would require additional supports for it to angle upward from the floor.

FIG. 5 is Prior Art of a perspective view of an enclosure marketed as the Cubedge® EDGE.Sound by Cubedge. The design shows a rectangular prism with a single truncated corner (42) intersecting with the first panel (30), the second panel (32) and the third panel (34). In this example the seventh panel created by the truncation (42) contains a power indicator light (78). Power button (120) and volume controls (54) are shown on the third panel (34) of the enclosure. The seventh panel created by the truncation (42) is not intended as a base. As in FIG. 1, FIG. 2 and FIG. 3, the enclosure indicates speakers on a single panel (30) which are, in this drawing, covered by a protective grill (94). Unlike the enclosures demonstrated in FIG. 1, FIG. 2 and FIG. 3, the enclosure does contain stereo speakers which reproduce two separate audio signals. However, like the enclosures in FIGS. 1, FIG. 2, and FIG. 3, this enclosure projects sound from its first panel (30) only and therefore only in a single general direction.

Figure 6:
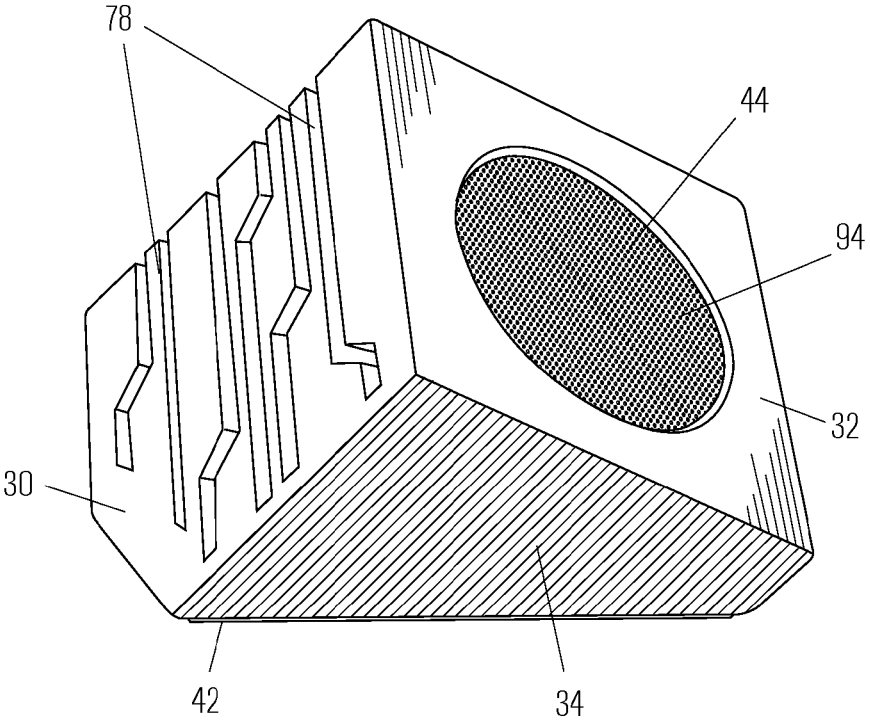
FIG. 6 PRIOR ART
FIG. 6 is prior art: a drawing of the GOgroove BLUESYNC EDG.

FIG. 6 is Prior Art of a perspective view of an enclosure marketed as the GOgroove BLUESYNC EDG by Accessory Power. The design shows a cuboid prism with a single truncated corner (42) intersecting with the first panel (30), the third panel (34) and a fourth panel. The seventh panel (42) created by the truncation is used as the primary base. Lights (78) which sit in channels cut into the first panel and, though not shown, are also mirrored on a fourth panel. The enclosure only provides for a speaker (44) on a second panel (32) which is, in this drawing, covered by a protective grill (94). The enclosure does not contain multiple speakers which reproduce two separate audio signals. This enclosure projects sound from its second panel (32) only and therefore only in one general direction.

DETAILED DESCRIPTION

FIGS. 7-11—First Embodiment

The first embodiment of the enclosure will be shown in FIGS. 7-11.

Figure 7:
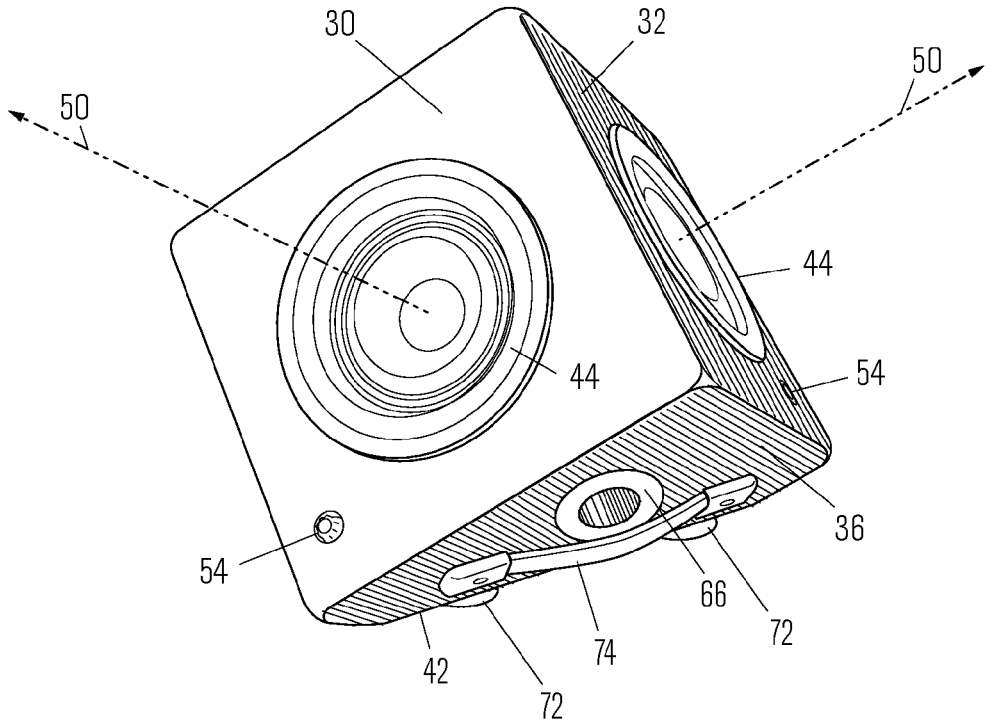
FIG. 7 is a perspective drawing of an embodiment of the enclosure as appearing from the left.

FIG. 7 is a perspective drawing of the enclosure as viewed from the left side. In this embodiment the general shape of the enclosure is of a cube with a radial dependent truncation on a single corner, the resulting plane acting as a primary base (42). What is shown is a first panel (30), a second panel (32) and a fourth panel (36), where the first panel (30) and the second panel (32) each have an opening or plurality of openings in which loudspeakers (44) can be mounted. When mounted on the first panel (30) and the second panel (32) the loudspeakers (44) are aimed upwards at an obtuse angle (50) to the primary base (42). Also shown on the first panel and second panel are openings to hold volume controls (54). The volume control (54) on the first panel (30) may control the volume of the loudspeaker (44) mounted on the first panel (30). Likewise, the volume control (54) on the second panel may control the volume of the loudspeaker (44) on the second panel (32). The circuitry used for controlling the volume of panel-mounted loudspeakers is demonstrated in FIG. 15.

A fourth panel (36) shows it can accommodate optional speaker enclosure accessories such as but not limited to a pole mount socket (66) and a handle (74). The primary base (42) and the secondary base (36) may also employ feet or pads (72) to protect the enclosure when resting directly on a surface.

Figure 8:
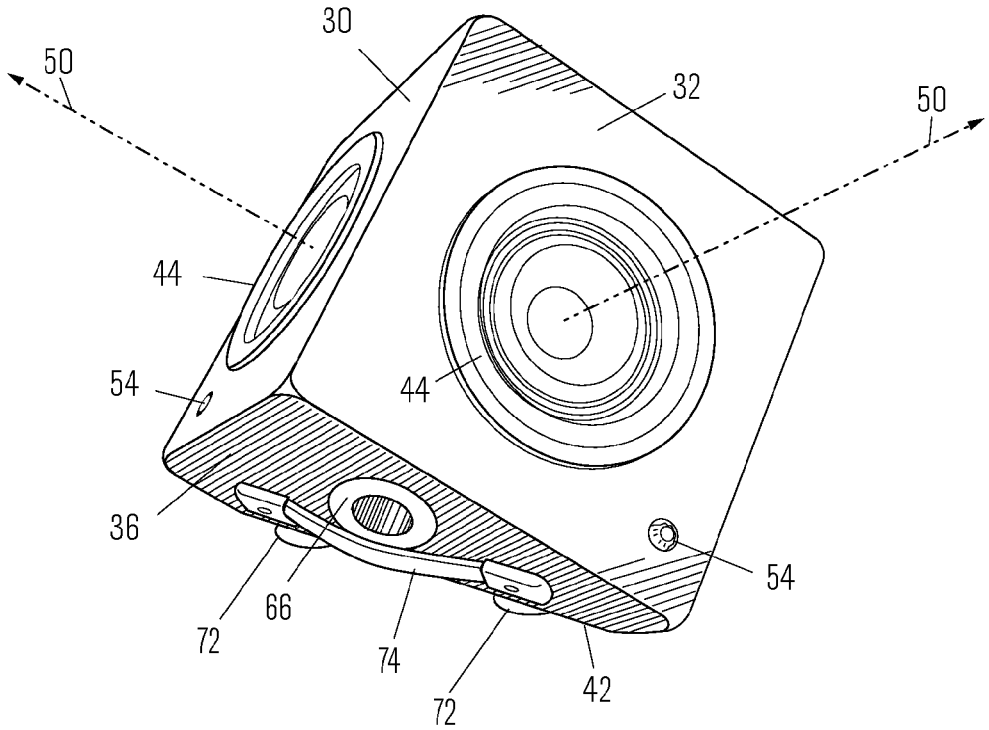
FIG. 8 is a perspective drawing of an embodiment of the enclosure appearing from the right.

FIG. 8 is a perspective drawing of the enclosure as viewed from the right side. Due to the symmetry of the enclosure, this drawing is essentially a mirror image of FIG. 7. In this embodiment the general shape of the enclosure is of a cube with a radial dependent truncation on a single corner, the resulting plane acting as a primary base (42). What is shown is a first panel (30), a second panel (32) and a fourth panel (36). The first panel (30) and the second panel (32) each have an opening or plurality of openings in which loudspeakers (44) can be mounted. When mounted on the first panel (30) and the second panel (32) the speakers are aimed upwards at an obtuse angle (50) to the primary base (42). Also shown on the first panel and second panel are openings to hold volume controls (54). The volume control (54) on the first panel (30) may control the volume of the loudspeaker (44) mounted on the first panel. Likewise, the volume control on the second panel (32) may control the volume of the loudspeaker (44) mounted on the second panel. The circuitry used for controlling the volume of panel-mounted loudspeakers is demonstrated in FIG. 15.

A fourth panel (36) shows it can accommodate optional speaker enclosure accessories such as but not limited to a pole mount socket (66) and a handle (74). The primary base (42) and the secondary base (36) may also employ feet or pads (72) to protect the enclosure when resting directly on a surface.

Figure 9:
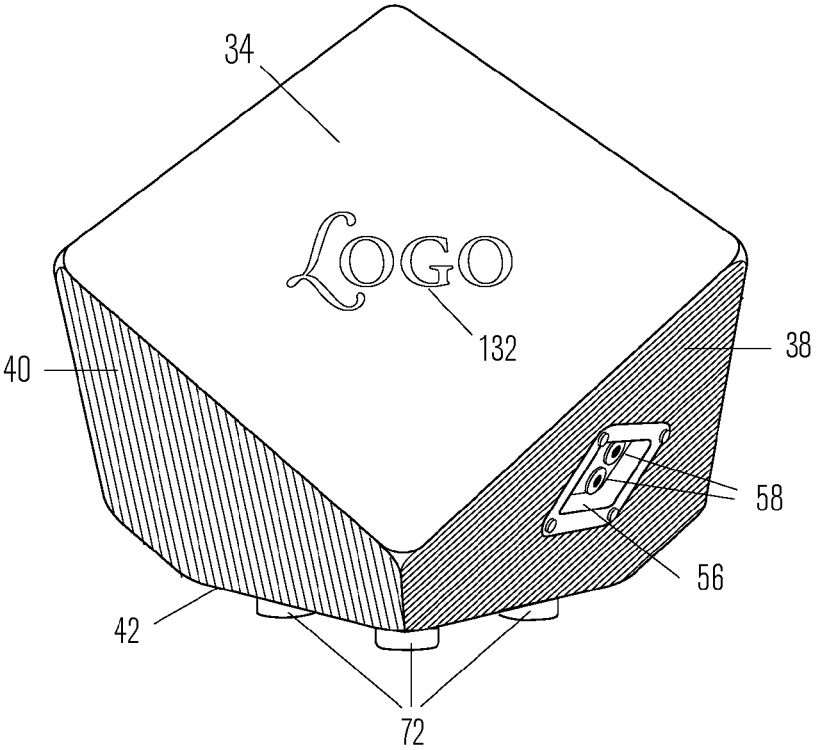
FIG. 9 is a perspective drawing of an embodiment of the enclosure appearing from the back.

FIG. 9 is a perspective drawing of the enclosure as viewed from the back. In this embodiment the general shape of the enclosure is of a cube with a radial dependent truncation on a single corner, the resulting plane acting as a primary base (42). This drawing shows a third panel (34), a fifth panel (38) and a sixth panel (40). The third panel (34), which might normally face towards an audience, is shown with no openings but may have graphics, indicia or logos (132) applied to it. Though not indicated, openings on the third panel (34) may be used depending on need for the addition of other accessories such as wireless connectivity or internal power amplifier or a plurality of amplifiers.

The fifth panel (38) and sixth panel (40) may have openings to hold accessories such as jackplates (56) so audio inputs or audio outputs (58) can be used to transfer audio signals from a common audio amplifier or to another external speaker. The primary base (42) may also employ feet or pads (72) to protect the enclosure when resting directly on a surface.

Figure 10:
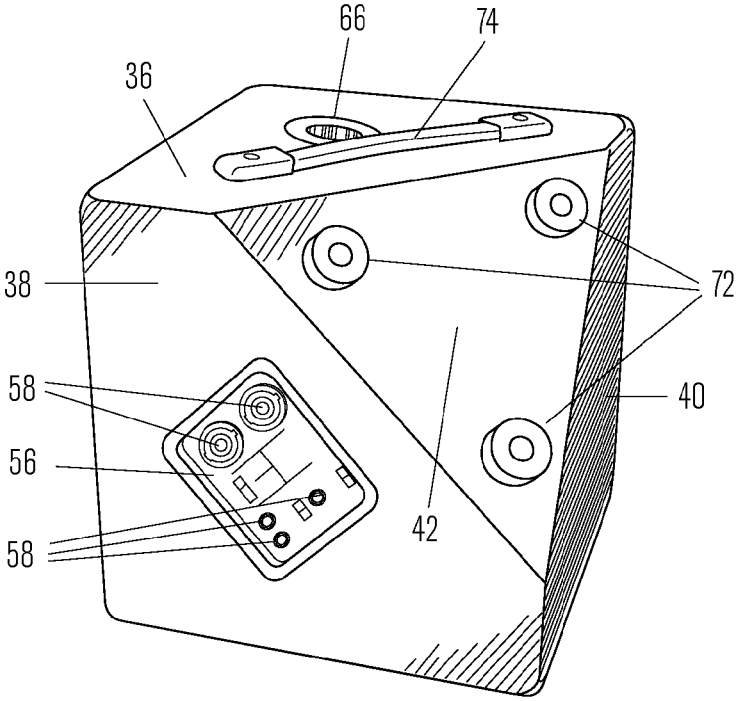
FIG. 10 is a perspective of an embodiment of the enclosure as appearing from the primary base.

FIG. 10 is a perspective view of the enclosure showing the primary and secondary bases. The seventh panel (42) is the primary base. The base is triangular and has optional feet or pads (72) attached for protection.

The fourth panel (36) is the secondary base and shows optional attachments of a pole socket (66) and a handle (74).

The fifth panel (38) shows a jackplate (56) mounted in an opening. The jackplate (56) holds audio inputs or outputs for the transfer of audio signals from a common audio amplifier. For simplicity of the drawing, the sixth panel (40) is shown without any openings or attachments. However, a manufacturer may create openings and add accessories as may be deemed necessary.

Figure 11:
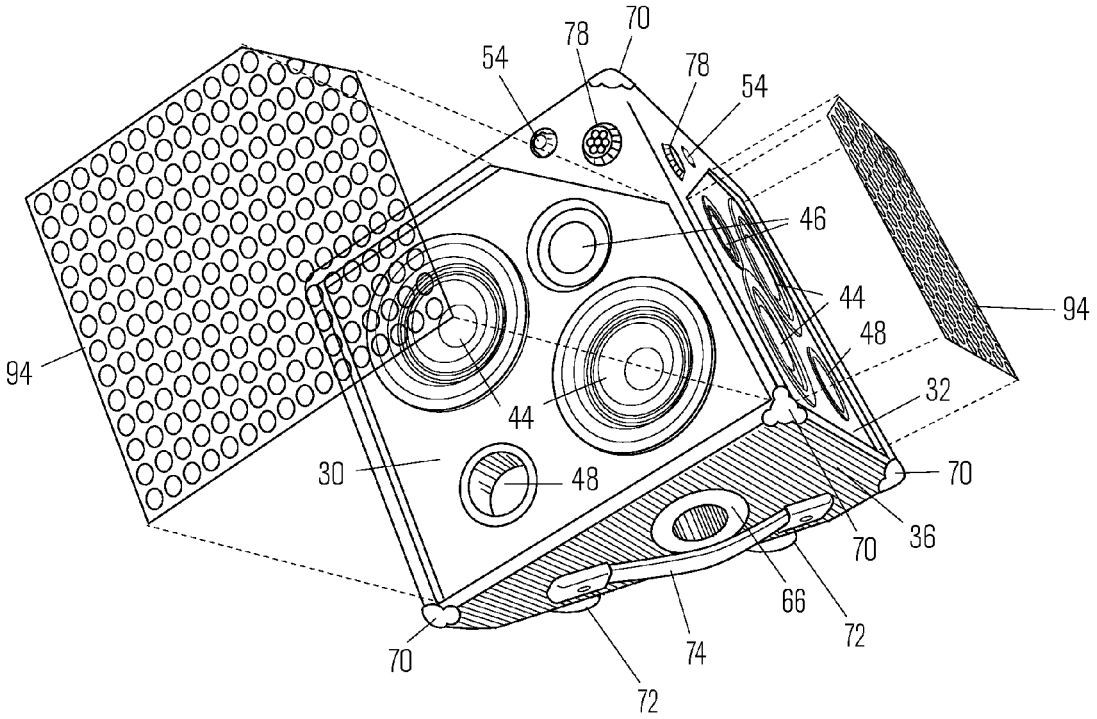
FIG. 11 is a perspective drawing of one embodiment of the enclosure showing a plurality of speakers, port openings, grills and typical accessories.

FIG. 11 is a perspective view of the enclosure showing the attachment of multiple loudspeakers, other devices for sound reproduction, and various accessories typically used in loudspeaker enclosure manufacture. Shown on the first panel (30) are a plurality of loudspeakers (44), a high frequency speaker (46) often referred to as a tweeter or piezo, and a port tube or port opening (48). Also shown on the first panel near the top of the enclosure is a volume control (54) and an electric light (78) which might be used as a power indicator light or used to illuminate a performer.

The second panel (32) has a similar configuration as the first panel (30) with a plurality of loudspeakers (44), a high frequency speaker (46) often referred to as a tweeter or piezo, and a port tube or port opening (48). Also shown on the second panel near the top of the enclosure is a volume control (54) and an electric light (78) which might be used as a power indicator light or used to illuminate a performer.

The fourth panel (36) has attachments of a pole socket (66) and a handle (74). Shown attached to the primary base are feet or pads (72). In order to improve enclosure protection during handling and transportation cabinet corners (70) are typically applied to the corners of the enclosure.

Protection of the loudspeakers (44), high frequency speakers (46), and port tubes is provided by acoustically-transparent grills (94) of metal, plastic, or other rigid material which are attached to the panels holding the loudspeakers and other devices of sound reproduction.

DETAILED DESCRIPTION

Figure 12:
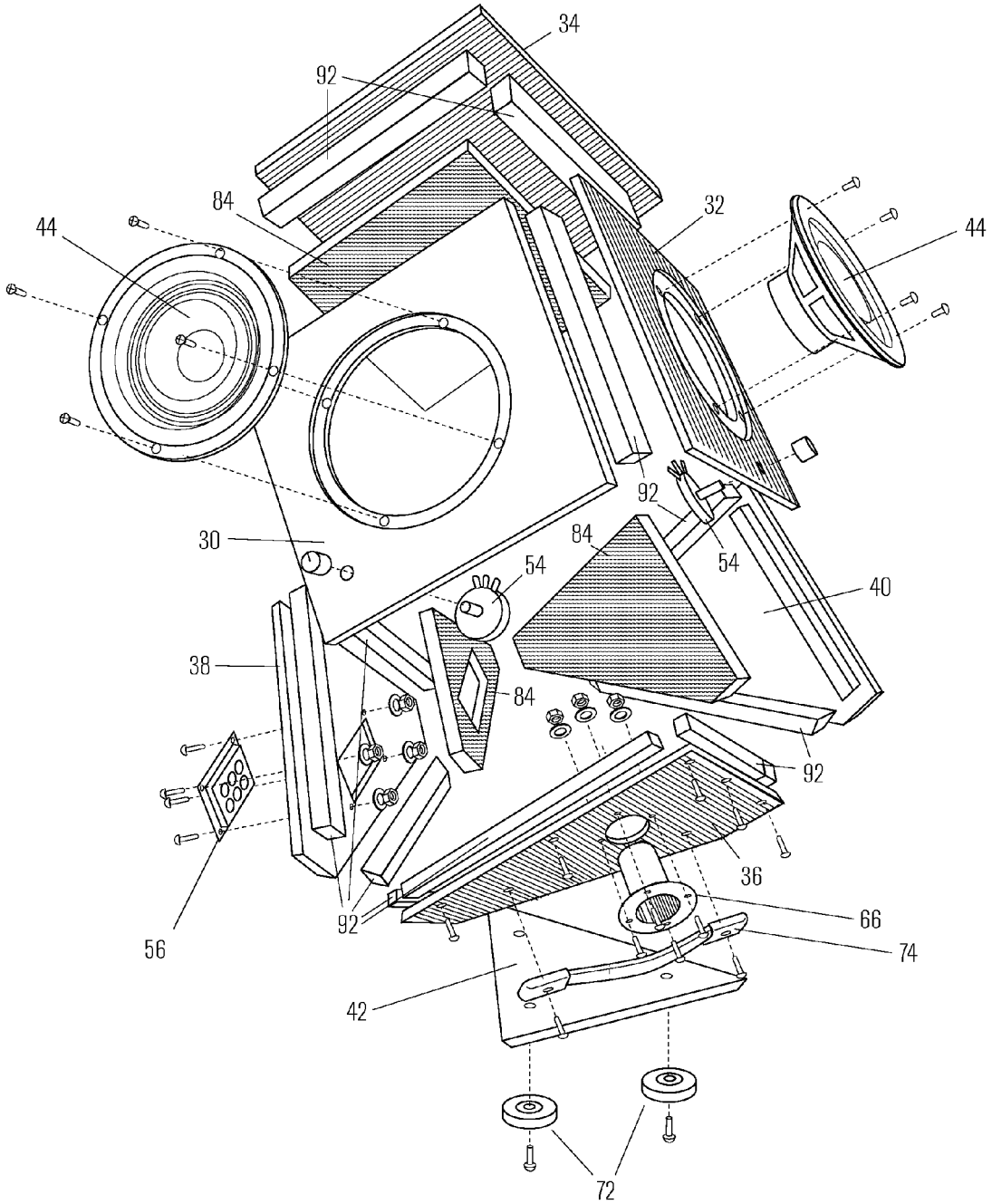
FIG. 12 is a drawing of one embodiment in an exploded view of typical plywood and bracing construction.
Figure 13:
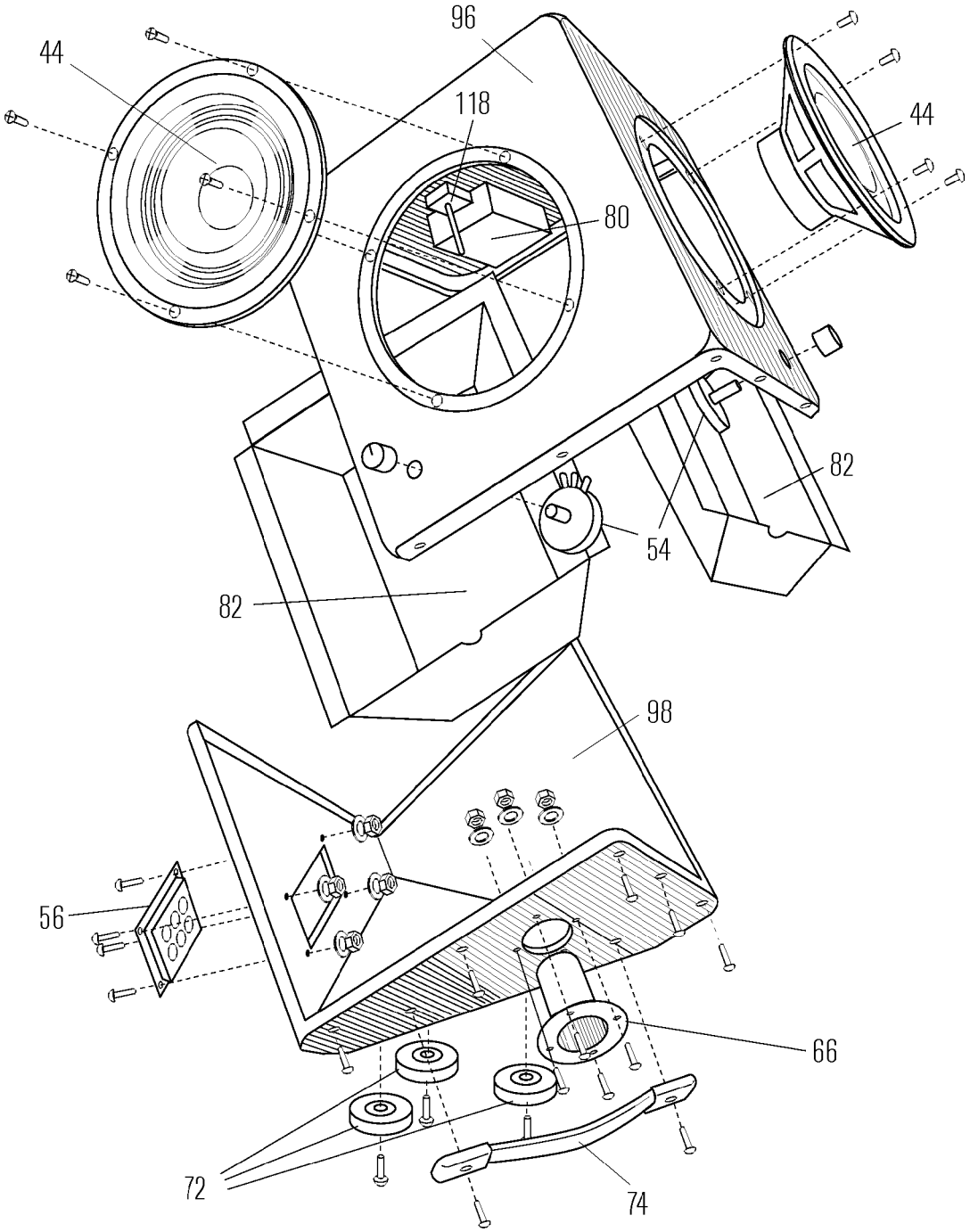
FIG. 13 is a drawing of one embodiment in an exploded view of possible two-part molded construction.

FIGS. 12-13—Construction Examples

Speaker enclosures are constructed from a wide variety of materials and methods. Most professional speaker enclosures are constructed of plywood, medium density fiberboard (MDF) panels, or of high-impact plastic such as acrylonitrile butadiene styrene (ABS), or polypropylene.

Usually, plywood or MDF enclosure construction employs simple joinery and fastening methods with internal bracing to add to the rigidity of the structure. Birch plywood is considered by many as the best material for its improved audio resonance over other materials.

Enclosures constructed of plastic are usually constructed of molded or extruded shapes and allow items like screw posts, bracing, and port tubes to be produced as part of an extrusion. Such manufacturing creates a more economical product for mass production. Metal speaker enclosures are not as common but can be manufactured in a variety of methods. It is not the intention of this description to define any specific method of manufacture. The following two drawings, FIG. 12 and FIG. 13, represent but a small example of possible designs, materials and methods possible.

FIG. 12 is an exploded view showing one method of the construction of the enclosure using primarily plywood or MDF panels and internal bracing. Plywood construction of loudspeaker enclosures is well-known and is often the choice of manufacturers for the purpose of superior audio resonance characteristics. MDF is often chosen for economy of production. This enclosure can be made to any scale and the selection of materials, thicknesses and dimensions are unspecified as these can be determined by the manufacturer according to their requirements. In this drawing, where panels intersect, a brace (92) of rigid material may be fastened by any method to the inside face of a panel where it joins with the inside face of another panel.

An optional sound absorbing material such as, but not limited to, acoustic foam or fabric (84) may be applied to the inside of any panel.

The panels do not have to intersect on their edges but simply near an edge so a portion of the panel may extend beyond the junction of two panels to allow the recession of a panel in the final enclosure.

The first panel (30) is attached on or near to the edge of the second panel (32) by method of screws, nails, glue, clips or other attachment. The third panel (34) is similarly attached to the edges of the first panel (30) and the second panel (32). The edges of the fifth panel (38) are similarly attached on or near to the edges of the first panel (30) and the third panel (34). The sixth panel (40) is similarly attached on or near to the edge of the second panel (32) and the third panel (34). The fourth panel (36) is similarly attached on or near to the edge the first panel (30), the second panel (32), the fifth panel (38) and the sixth panel (40).

At this point an enclosure is made with an opening at its primary base. This allows the attachment or installation of typical speaker enclosure components such as but not limited to loudspeakers (44) or other sound-producing devices, jackplates (56), audio inputs or outputs (not shown), wire (not shown) to connect the audio input to volume controls (54), crossovers (not shown), loudspeakers (44) or high-frequency speaker (46).

In addition, the opening allows optional accessories such as but not limited to pole mounts (66) and handles (74) to be fastened on the inside face of a panel.

Feet or pads (72) are attached to the seventh panel (42) and this assembly of seventh panel (42) and feet or pads (72) are attached on or near to the edges of the fourth panel (36), the fifth panel (38) and the sixth panel (40).

In this drawing any panel may be used as the last panel to be attached and its void used as access for the installation of components and accessories.

FIG. 13 is an exploded view showing one method of molded construction where the enclosure is constructed in two parts. The enclosure can be of any rigid mold-able material including but not limited to plastic, composites or metal. This construction method is suited for mass production where economy of construction is important. A first panel, a second panel and a third panel are manufactured as a single top unit (96) as shown in the drawing. The fourth panel, fifth panel sixth panel, and seventh panel are manufactured as a single bottom unit (98) as shown in the drawing.

Typical speaker enclosure components such as, but not limited to, loudspeakers (44) or other sound-producing devices, jackplates (56), audio inputs or outputs (58), wiring (not shown), volume controls (54), crossovers (not shown), pole mounts (66), internal audio amplifier (80), wireless receiver (118) handles (74) and feet or pads may be installed where required.

The drawing also demonstrates the addition of internal baffles (82) which are fastened to one or more internal faces. Baffles (82) are commonly designed and placed internally for controlling speaker resonance in predetermined combinations of speakers, enclosure size, construction and materials. Baffles (82) as drawn are only one of many possible designs which may be employed.

Access to internal components can also be through a loudspeaker opening, removable panel or door, or by removal of the top molded unit (96) from the bottom molded unit (98).

DETAILED DESCRIPTION

Figure 14:
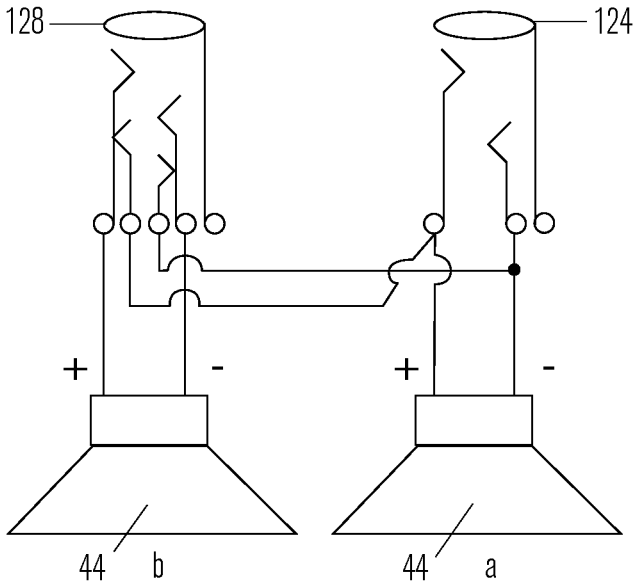
FIG. 14 PRIOR ART
FIG. 14 is prior art: electrical circuit diagram for a speaker enclosure where a first audio signal is sent to two speakers and when a second audio signal is added each speaker set has independent and separate signals.
Figure 15:
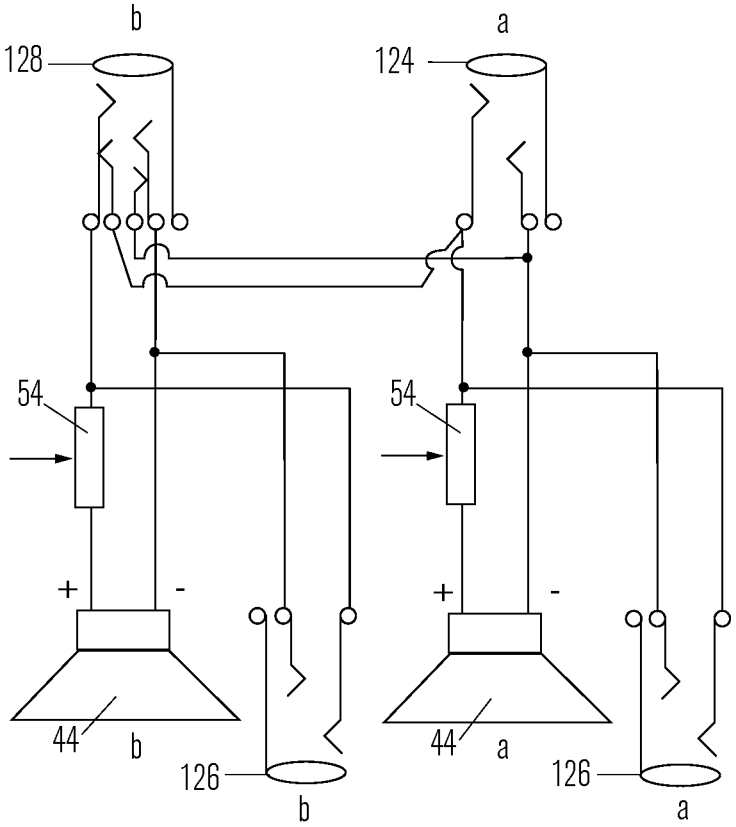
FIG. 15 is an improvement of FIG. 14 where the audio signals are sent to their respective speakers and to output jacks for adding more speakers and where volume controls are added to the signal going to the speakers.

FIG. 14-15—Circuitry of First Embodiment

In order for the enclosure to operate as described in FIGS. 18-21 utilizing a plurality of unique signals and volume control to different loudspeakers or groups of devices for sound reproduction, it is necessary to employ electrical circuitry.

FIG. 14 is prior art of a known diagram of circuitry used to allow a first audio signal to be shared by a plurality of speakers, and when a second audio signal is introduced, the circuit supports both signals, sending them to separate speakers. What is shown is a mono ¼ inch phone jack input (124), a ¼ inch stereo phone jack input (128), two speakers (44) and a simple circuit.

When a mono phone plug carrying a first audio signal is inserted into the mono audio input (124) the signal travels through the circuit directly to a first speaker "a" (44) and though the stereo audio input (128) to the second speaker "b" (44). This results in the first audio signal being directed to two speakers.

When a second mono phone plug carrying a second audio signal is inserted into the stereo audio input receptacle (128), it physically opens the connections from the mono audio input preventing the first signal from being directed to the second speaker "b" (44). The first signal is still directed to the first speaker "a" (44) and the second audio signal is directed to the second speaker "b" (44).

If no mono plug is inserted into the mono audio input "a" and a a stereo phone plug is inserted into audio input 'b' while carrying a stereo signal—a left channel signal and a right channel signal—the left signal will be transferred to speaker "b" and audio output "b". The right channel signal will be transferred to speaker "a" and audio output "a."

FIG. 15 shows an improvement on the prior art of FIG. 14 where the circuitry has a similar function as FIG. 14 with the added features of volume controls for use with independent speakers, and mono audio signal outputs to allow for additional speakers to share an audio signal. The circuit described may be used with the first embodiment of the enclosure but is not restrictive as other circuits may be employed in the enclosure.

When a mono phone plug carrying a first audio signal is inserted into the mono audio input "a" (124) the audio signal travels through the circuit directly to a first speaker "a" (44) and though the stereo audio input "b" (128) to the second speaker "b" (44). This results in the first audio signal being directed to two speakers. The first signal is also directed to two mono audio outputs "a" and "b" (126) to allow for additional speakers to share the first audio signal.

When a second mono phone plug carrying a second audio signal is inserted into the stereo audio input "b" (128), it physically opens the connections from the mono audio input preventing the first signal from being directed to the second speaker "b" (44) and to the audio output "b" (126). The first signal is still directed to the first speaker "a" (44) and the first mono audio output "a" (126). The second audio signal is directed to the second speaker "b" (44) and the second mono audio output "b" (126).

If no mono plug is inserted into the mono audio input "a" and a a stereo phone plug is inserted into audio input 'b' while carrying a stereo signal—a left channel signal and a right channel signal—the left signal will be transferred to speaker "b" and audio output "b". The right channel signal will be transferred to speaker "a" and audio output "a."

The volume controls (54) are situated within the circuit so as to control the volume of the audio signal to the speaker and not affect the audio signal directed to the audio output.

DETAILED DESCRIPTION

FIG. 16-21—Operation of First Embodiment

Due to the enclosure's features, capabilities and flexibility of use this description can only provide but a few of the possible methods for operating the enclosure. It is the intent of this description to encompass within the language any method of operation presently existing or developed in the future.

The enclosure is capable of being placed on a floor or horizontal surface, or elevated by use of a pole mount or speaker stand.

When the enclosure is placed on its primary base, the panels with mounted devices of sound reproduction are tilted upwardly at an obtuse angle to the floor or horizontal surface but at substantially different general directions from one another. Depending on the dispersion cones of sound and mounting methods used for predetermined devices for sound reproduction, this separation can allow for little or no overlap of sound emanating from each panel. Therefore, separate and individual sound signals can be directed to the devices mounted on the individual panels and one enclosure can allow two separate fields of sound aimed at an upward angle towards two individual performers or two groups of performers.

When resting on its primary base, the panels holding devices for sound reproduction can also be turned towards an audience and deliver either a wider field of sound from a single signal or separate signals towards different sections of an audience. The upward angle of the speakers created by resting on the primary base allows for the enclosure to be placed low on the floor and have the sound reach an audience in a raised section of a theater or balcony without the need for raising the enclosure on a pole or suspended from a ceiling or wall, reducing installation costs and complexity.

When placed on its secondary base, the panels holding the devices for sound reproduction are perpendicular to the horizontal surface and the enclosure can act as a wide array main speaker or as a stereo main speaker. If each set of devices for sound reproduction are controlled by its own optional volume control, the device volumes are independent and either side can have reduced volume allowing an operator to adjust the volumes for any given situation. If one group of devices for sound reproduction one panel have their volume eliminated or reduced significantly, the enclosure, with only a single group of devices for sound reproduction on a single panel, can be used as a conventional main speaker.

The enclosure can be mounted to a wall or suspended from a ceiling using a variety of hardware, or pole mounted using an optional pole socket. A pole socket could be mounted on any panel of the enclosure but the preferred positions are either on the secondary base or on the topmost sixth panel.

Figure 16:
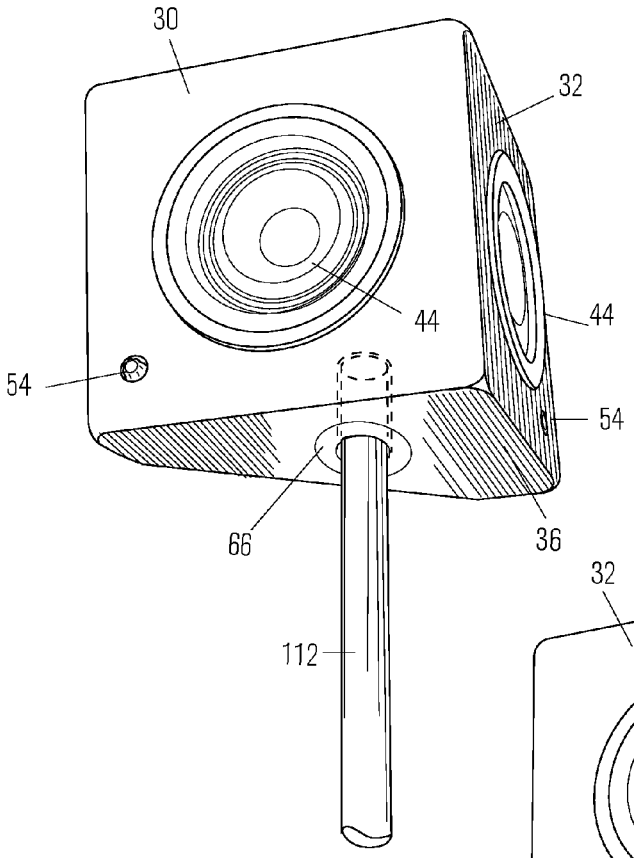
FIG. 16 is a drawing of one embodiment of the enclosure with a pole socket mounted on the fourth panel as used on a pole.

FIG. 16 is a perspective view of the enclosure as viewed from an angle below the enclosure showing how it can be used with a pole or speaker stand (112) and a pole mount (66) on the fourth panel (36) to raise the enclosure to any height necessary. A pole socket (66) may be attached either internally or externally depending on the design and construction of the pole socket device used.

The drawing demonstrates the attachment of an internal pole socket (66) to the fourth panel (36). When the enclosure is placed on a pole or pole stand (112) by insertion into the pole socket (66) the loudspeakers (44) or other devices for sound reproduction on the first panel (30) are directed in a substantially different direction than the loudspeaker or other devices for sound reproduction on the second panel (32). The difference in angle allows the loudspeakers and other devices of sound reproduction to project sound to different areas or a wider area depending on the dispersion cones of sound from a predetermined set of devices. Volume controls (54) allow the loudspeakers or other sound-producing devices on the first panel (30) to be set at a separate volume level than the loudspeaker or other sound-producing devices on the second panel (32).

Figure 17:
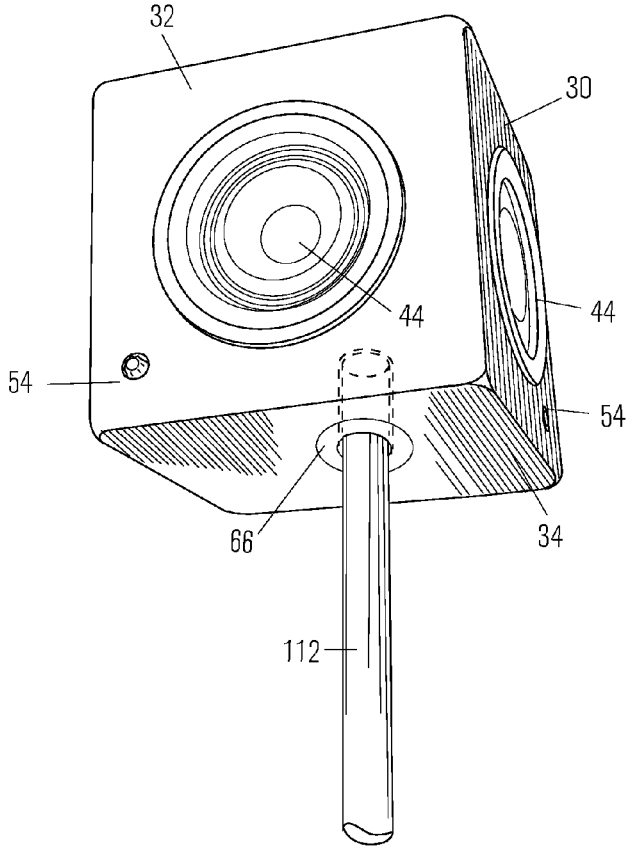
FIG. 17 is a drawing of one embodiment of the enclosure with a pole socket mounted on the third panel as used on a pole.

FIG. 17 is a perspective view of the enclosure as viewed from an angle below the enclosure showing how it can be used with a pole or speaker stand (112) and a pole mount (66) on the third panel (34) to raise the enclosure to any height necessary. A pole socket (66) may be attached either internally or externally depending on the design and construction of the pole socket device used.

The drawing demonstrates the attachment of an internal pole socket (66) to the third panel (34). The resulting operation and benefits would be identical to FIG. 16.

In order to better understand the novelty and usefulness of the enclosure, describing its use in a variety of situations may be helpful. Shown are only examples of possible uses and are not intended to restrict possible uses of the enclosure as many combinations of enclosure embodiments, devices for sound reproduction, audio signal number and combinations, and stage layouts are possible. A professional working in the field of stage or theatrical sound will understand and appreciate the novelty and many advantages of this enclosure over conventional speaker enclosures.

Figure 18:
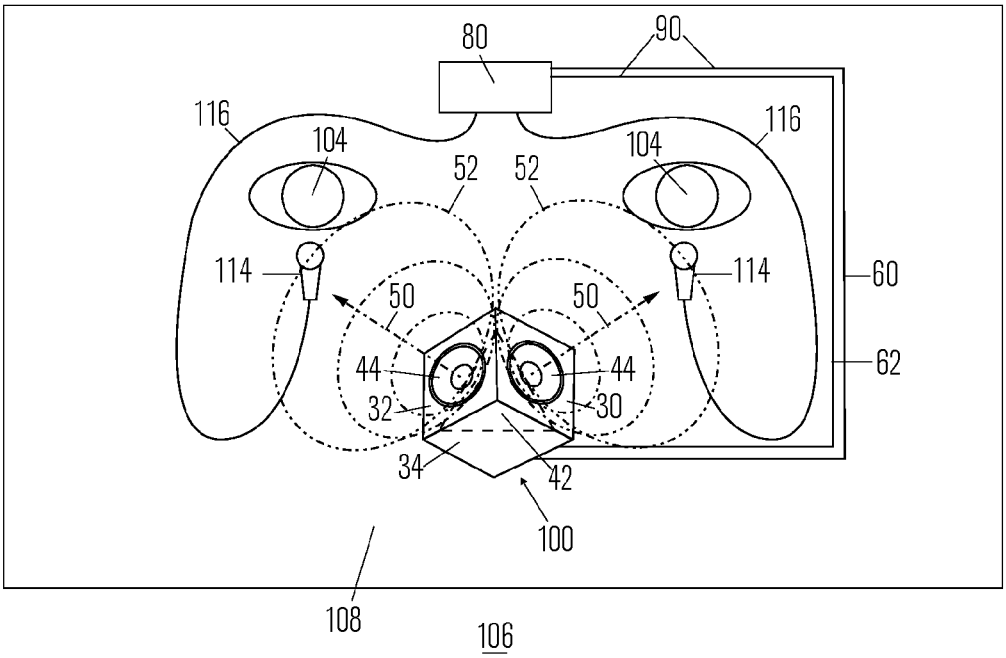
FIG. 18 is an overhead view diagram of a performance setup using the enclosure as a double floor monitor.

FIG. 18 is a top view diagram of a stage where multiple performers using a single enclosure hear themselves through a floor monitor. What is shown is a stage (108), an audience area (106), multiple performers (104), microphones (114), a common audio amplifier (80), cables (116) connecting the microphones (114) to the amplifier (80), an audio signal cable or a plurality of cables (90) connecting the amplifier (80) to the first embodiment enclosure (100) resting on its primary base (42) thereby presenting the loudspeakers (44) on the first panel (30) and second panel (32) at an upward angle and direction (50).

Performers (104) vocalize into microphones (114) which are connected by audio cables (116) to an audio amplifier (80) which amplifies the audio signals from the microphones (114) and transfers them through audio cables (90) to a loudspeaker (44). If there is a first audio signal only, it can be replicated by the loudspeakers (44) on the first panel (30) and the second panel (32). If a second audio signal (62) is transferred from the amplifier (80) to the enclosure (100), it can be directed to the loudspeaker (44) on the second panel (32).

Figure 19:
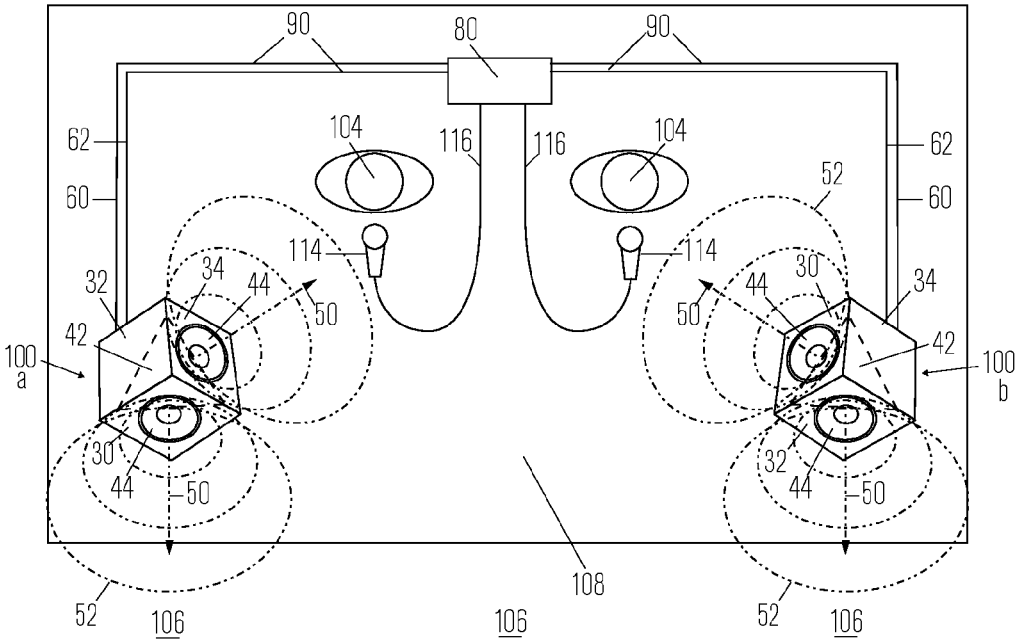
FIG. 19 is an overhead view diagram of a performance setup using two enclosures as combination main speakers and side-fill monitors on two sides.

FIG. 19 is a top view diagram of a stage where multiple performers using a plurality of enclosures hear themselves through floor monitors and have the audience also hear their performance. This diagram describes a use of the first embodiment of the enclosure as both a floor monitor and main speakers. What is shown is a stage (108), an audience area (106), multiple performers (104), microphones (114), a common audio amplifier (80), cables (116) connecting the microphones (114) to the amplifier (80), an audio signal cable or a plurality of cables (90) connecting the amplifier (80) to the enclosure (100) resting on its primary base (42) thereby presenting the loudspeakers (44) on the first panel (30) and second panel (32) at an upward angle.

Performers (104) vocalize into microphones (114) which are connected by audio cables (116) to an audio amplifier (80)

which amplifies the audio signals from the microphones (114) and transfers them through audio cables (90) to a loudspeaker (44). A first audio signal (60) and second audio signal are transferred from the amplifier (80) to the enclosures "a" and "b" (100).

The enclosures "a" and "b" (100) are configured to send a first audio signal (60) to loudspeakers (44) on audience-facing panels on the enclosures (100) and a second audio signal to the loudspeakers (44) on performer-facing panels of the enclosures (100). The dispersion of sound (52) can be wide or narrow depending on the specific loudspeakers (44) used and how they are mounted to the enclosure. Volume controls for the loudspeakers (44) on individual panels can be used to increase sound where needed and decrease sound where appropriate, such as being reduced for the stage performers.

Figure 20:
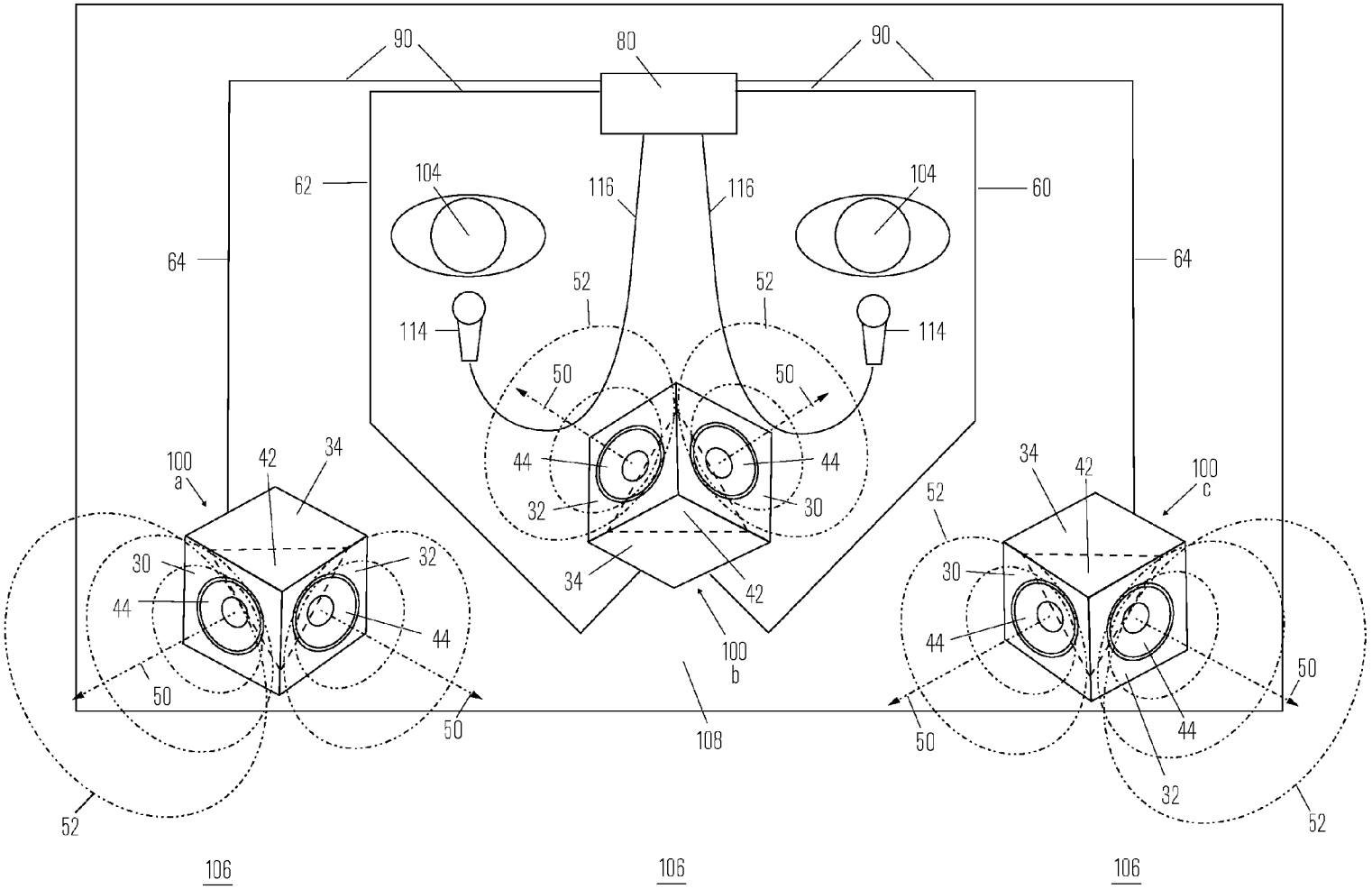
FIG. 20 is an overhead view diagram of a performance setup using four enclosures as wide dispersion main speakers on four corners and one enclosure as a double monitor.

FIG. 20 is a top view diagram of a stage where multiple performers using a plurality of enclosures hear themselves through a floor monitor and have the audience also hear their performance. This diagram describes a use of the first embodiment of the enclosure as both a floor monitor and as wide dispersion main speakers. What is shown is a stage (108), an audience area (106), multiple performers (104), microphones (114), a common audio amplifier (80), cables (116) connecting the microphones (114) to the amplifier (80), an audio signal cable or a plurality of cables (90) connecting the amplifier (80) to the enclosure (100) resting on its primary base (42) thereby presenting the loudspeakers (44) on the first panel (30), and a second panel (32) at an upward angle.

Performers (104) vocalize into microphones (114) which are connected by audio cables (116) to an audio amplifier (80) which amplifies the audio signals from the microphones (114) and transfers them through audio cables (90) to a loudspeaker (44). A first audio signal (60) and second audio signal are transferred from the amplifier (80) to the enclosures "a" and "b" (100).

Performers (104) vocalize into microphones (114) which are connected by audio cables (116) to an audio amplifier (80) which amplifies the audio signals from the microphones (114) and transfers them through audio cables (90) to a loudspeaker (44). A first audio signal (60) is transferred from the amplifier (80) to the performer-facing enclosure "b" (100) and directed to the loudspeakers (44) on the first panel (30). A second audio signal (62) is transferred from the amplifier (80) to the performer-facing enclosure "b" (100) and directed to the loudspeakers (44) on the second panel (33).

A third audio signal (64) is directed to the loudspeakers (44) on the first panel (30) and the second panel (32) of the audience-facing enclosures "a" and "c" (100).

The dispersion of sound (52) can be wide or narrow depending on the specific loudspeakers (44) used. Volume controls for the loudspeakers (44) on individual panels can be used to increase sound where needed and decrease sound where appropriate, such as close to the stage.

Figure 21:
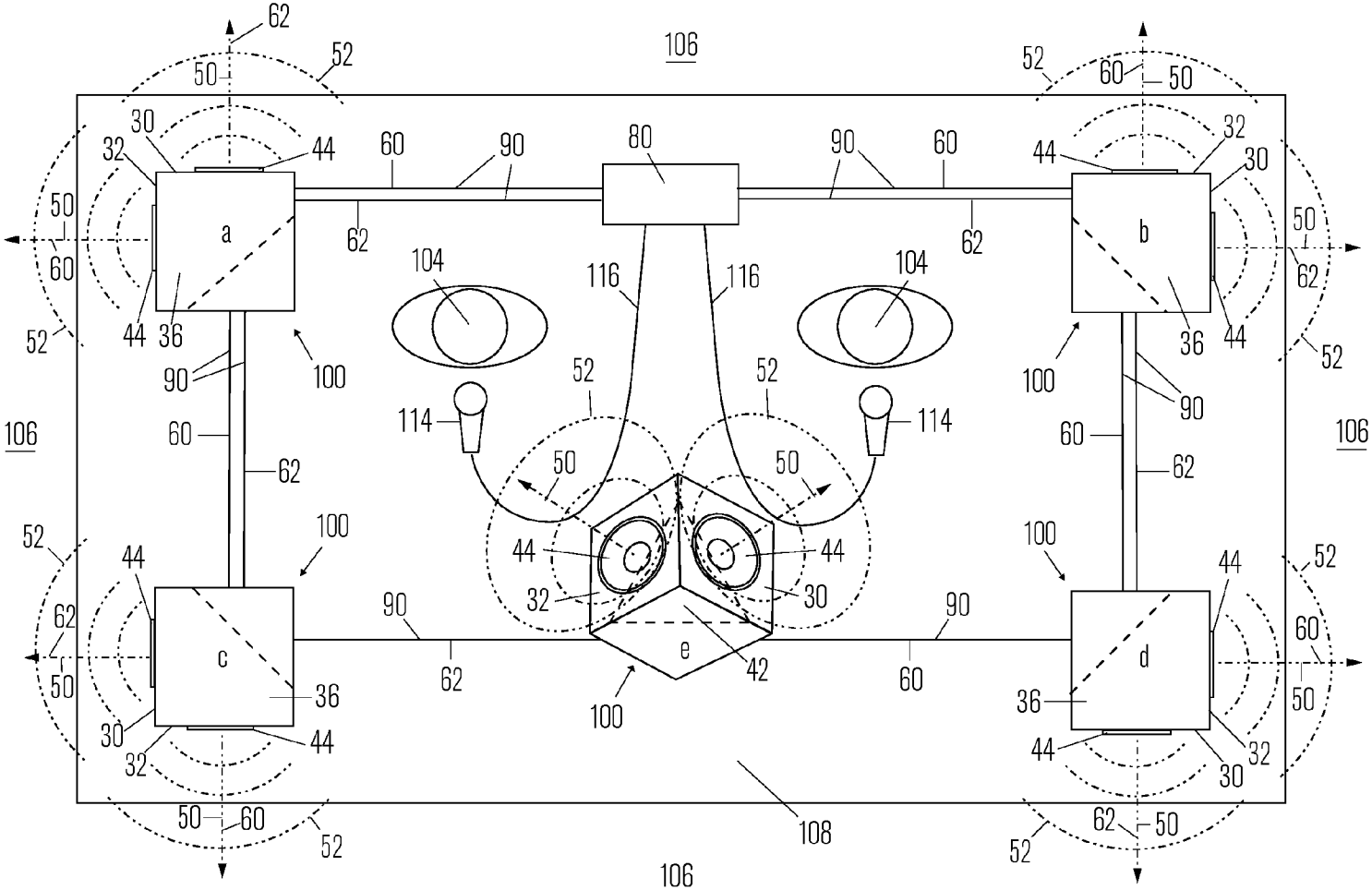
FIG. 21 is an overhead view diagram of a performance setup using four enclosures as wide dispersion main speakers on four corners and one enclosure as a double monitor.

FIG. 21 is a top view diagram of a stage where multiple performers using a plurality of enclosures hear themselves in stereo through a floor monitor and have a surrounding audience also hear their performance in stereo. This diagram describes a use of the first embodiment of the enclosure as a floor monitor and a plurality of first embodiment enclosures as audience-facing stereo main speakers. What is shown is a stage (108), a plurality of audience areas (106), a plurality of performers (104), microphones (114), a common audio amplifier (80), cables (116) connecting the microphones (114) to the amplifier (80), a plurality of cables (90) connecting the amplifier (80) to the performer-facing first embodiment of the enclosure "e" (100) resting on its primary base (42) thereby presenting the loudspeakers (44) on the first panel (30) and second panel (32) at an upward angle and direction (50). Also shown are cables (90) connecting the amplifier (80) to a plurality of audience-facing first embodiment enclosures "a", "b", "c", and "d" (100) resting on their secondary base (36) thereby presenting the loudspeakers (44) on the first panel (30) and loudspeaker (44) on the second panel (32) perpendicular to the stage (108) so the direction of sound is a substantially horizontal direction (50) towards an audience (106).

Performers (104) vocalize into microphones (114) which are connected by audio cables (116) to an audio amplifier (80) which amplifies the audio signals from the microphones (114) and transfers them through audio cables (90) to a loudspeaker (44). A first audio signal (60), which shall be considered a stereo left signal, and a second audio signal (62), which shall be considered a stereo right signal, is transferred from the amplifier (80) to the audience-facing first embodiment enclosures "a" and "b" (100).

On enclosure "a" the stereo right signal (62) is directed to the loudspeaker (44) on the first panel (30) and the stereo left stereo signal (60) is directed to the loudspeaker (44) on the second panel (32). The stereo right signal (62) and stereo left signal (60) are, in turn, directed to an audio output on enclosure "a" and through cables (90) to enclosure "c" (100). At enclosure "c" (100) the stereo right signal (62) is directed to the loudspeaker (44) on the first panel (30) and the stereo left signal (60) is directed to the loudspeaker (44) on the second panel (32). The stereo right signal (62) is also, in turn, directed to an audio output on enclosure "c" (100) and through cables (90) to the performer-facing enclosure "e" (100) where the stereo right signal (62) is directed to the loudspeaker (44) on the second panel (32).

On enclosure "b" (100) the stereo right signal (62) is directed to the loudspeaker (44) on the first panel (30) and the stereo left signal (60) is directed to the loudspeaker (44) on the second panel (32). The stereo right signal (62) and stereo left signal (60) are, in turn, directed to an audio output on enclosure "b" and through cables (90) to enclosure "d" (100). At enclosure "d" (100) the stereo right signal (62) is directed to the loudspeaker (44) on the first panel (30) and the stereo left signal (60) is directed to the loudspeaker (44) on the second panel (32). The stereo left signal (60) is, in turn, directed to an audio output on enclosure "d" (100) and through cables (90) to the performer-facing enclosure "e" (100) where the stereo left signal (60) is directed to the loudspeaker (44) on the first panel (30).

DETAILED DESCRIPTION

Figure 22:
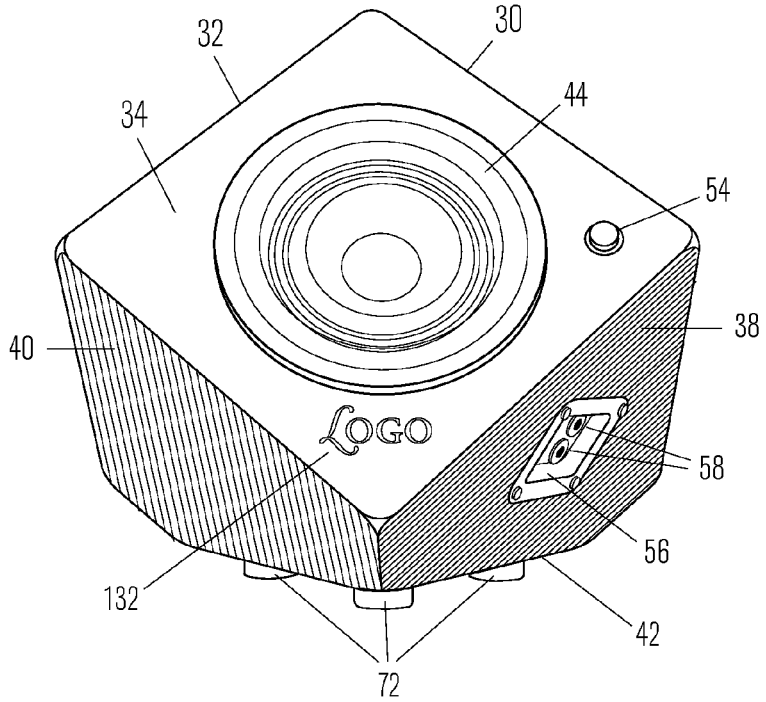
FIG. 22 is a perspective drawing of a second embodiment of the enclosure appearing from the back containing a third speaker panel.

FIG. 22—Second Embodiment

The second embodiment of the enclosure is represented by the first embodiment shown in previous FIGS. 7-11 with the addition of devices for sound reproduction on the third panel of the enclosure. This physical addition introduces features and capabilities to the previously detailed enclosure as will be demonstrated in FIGS. 23, 24, and 25.

FIG. 22 is a perspective view of the second embodiment of the enclosure as seen from the back. What is shown is the third panel (34), the fifth panel (38) the sixth panel (40), a loudspeaker (44) mounted within an opening on the third panel (34), a logo, graphic or indicia (132) applied to the third panel (34), a jackplate (56) with audio jacks (58) attached to an opening in the fifth panel (38), and feet or pads (72) applied to the seventh panel (42). A volume control (54) mounted through an opening allows the loudspeakers or other sound-producing devices on the third panel (34) to be set at a separate volume level than the loudspeakers or other devices for sound reproduction on the first panel (30) or second panel (32).

DETAILED DESCRIPTION

Figure 23:
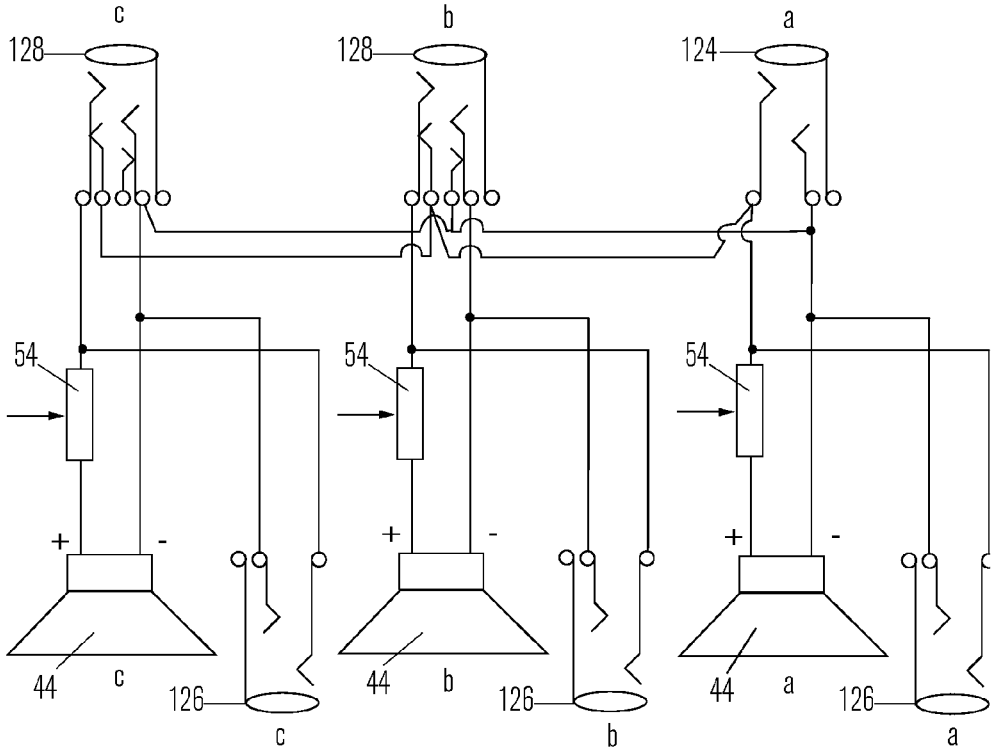
FIG. 23 is an electrical circuit based on FIG. 15 where three independent signals and volume controls may be used.

FIG. 23—Circuitry of Second Embodiment

FIG. 23 describes an improvement on the electrical circuit of FIG. 15 with an additional third audio input "c" (128), a third speaker "c" (44), a third audio output (126) and a third volume control. The circuit described can be used with the second embodiment of the enclosure but is not restrictive as other circuits may be employed in the enclosure.

When a mono phone plug carrying a first audio signal is inserted into the mono audio input "a" (124) the signal travels through the circuit directly to a first speaker "a" (44) and to the mono output "a" (126). The first audio signal passes though the stereo audio input "b" (128) to the second speaker "b" (44) and the mono audio output "b" (126). The first audio signal passes through the stereo input "b" (128) and through stereo audio input "c" (128) to third speaker "c" (44) and the mono audio output "c" (126). This results in the first audio signal being directed to three speakers and three mono audio outputs.

When a second mono phone plug carrying a second audio signal is inserted into the stereo audio input receptacle "b" (128), it physically opens the connections from the mono audio input preventing the first signal from being directed to the second speaker "b" (44), the audio output "b" (126), the audio input "c" (128), third speaker "c" (44) and audio output "c" (126). The first signal is still directed to the first speaker "a" (44) and the first audio output "a" (126). The second audio signal is directed to the second speaker "b" (44) and the second audio output "b" (126). The first signal is directed through stereo audio input "c" (128) to third speaker "c" (44) and the mono audio output "c" (126).

When a third mono phone plug carrying a third audio signal is inserted into the stereo audio input receptacle "c" (128), it physically opens the connections from the first mono audio input preventing the first signal from being directed to the third speaker "c" (44) and the audio output "c" (126). The first signal would still be directed to the first speaker "a" (44) and the first audio output "a" (126). If a second mono phone plug is inserted into stereo input "b" it will be directed to the second speaker "b" (44) and the second audio output "b" (126). If no phone plug is inserted into stereo audio input "b" (128) then the first signal will be directed to the first speaker "a" (44), the first mono audio output "a" (126), the second speaker "b" (44) and the second mono audio output "b" (126).

If no mono plug is inserted into the mono audio input "a" and a a stereo phone plug is inserted into audio input 'b" while carrying a stereo signal—a left channel signal and a right channel signal—the left signal will be transferred to speaker "b" and audio output "b", as well as speaker "c" (44) and output "c". The right channel signal will be transferred to speaker "a" and audio output "a."

If the left signal is not desired in speaker "c" and output "c", a breaker switch (not shown) can be employed on the circuit connecting the stereo audio input "b" (128) and stereo audio input "c" (128).

The volume controls (54) are situated in the circuit so as to control the volume of the audio signal to the speaker and not affect the audio signal directed to the audio output.

DETAILED DESCRIPTION

Figure 24:
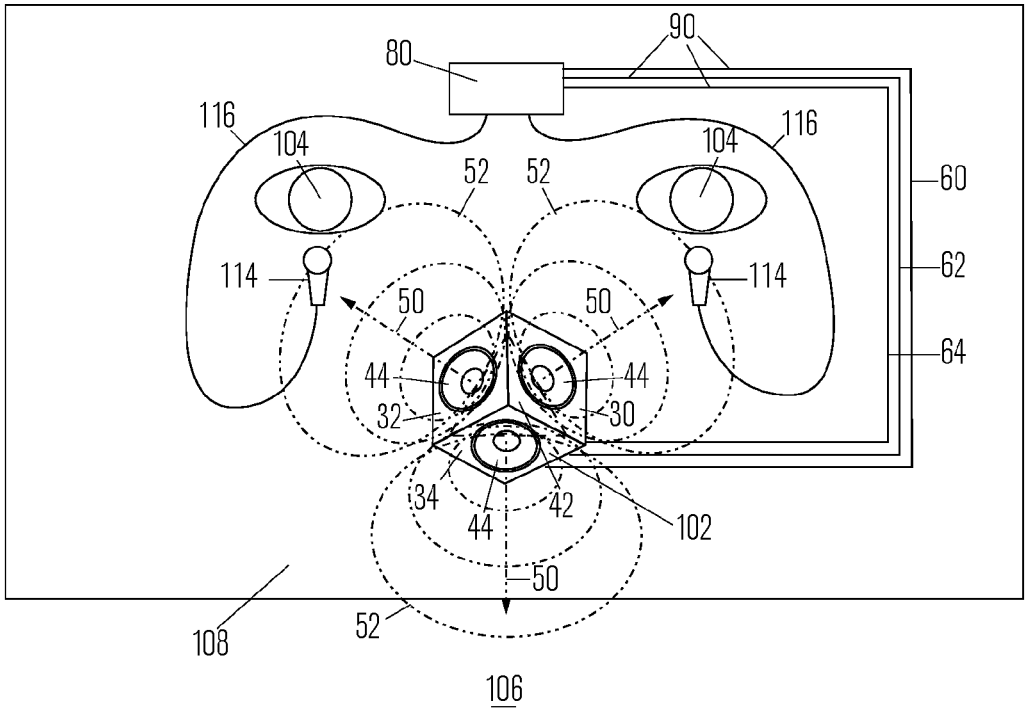
FIG. 24 is an overhead view diagram of a performance setup using the enclosure as a double monitor, and as a main speaker enabled by a third panel speaker.
Figure 25:
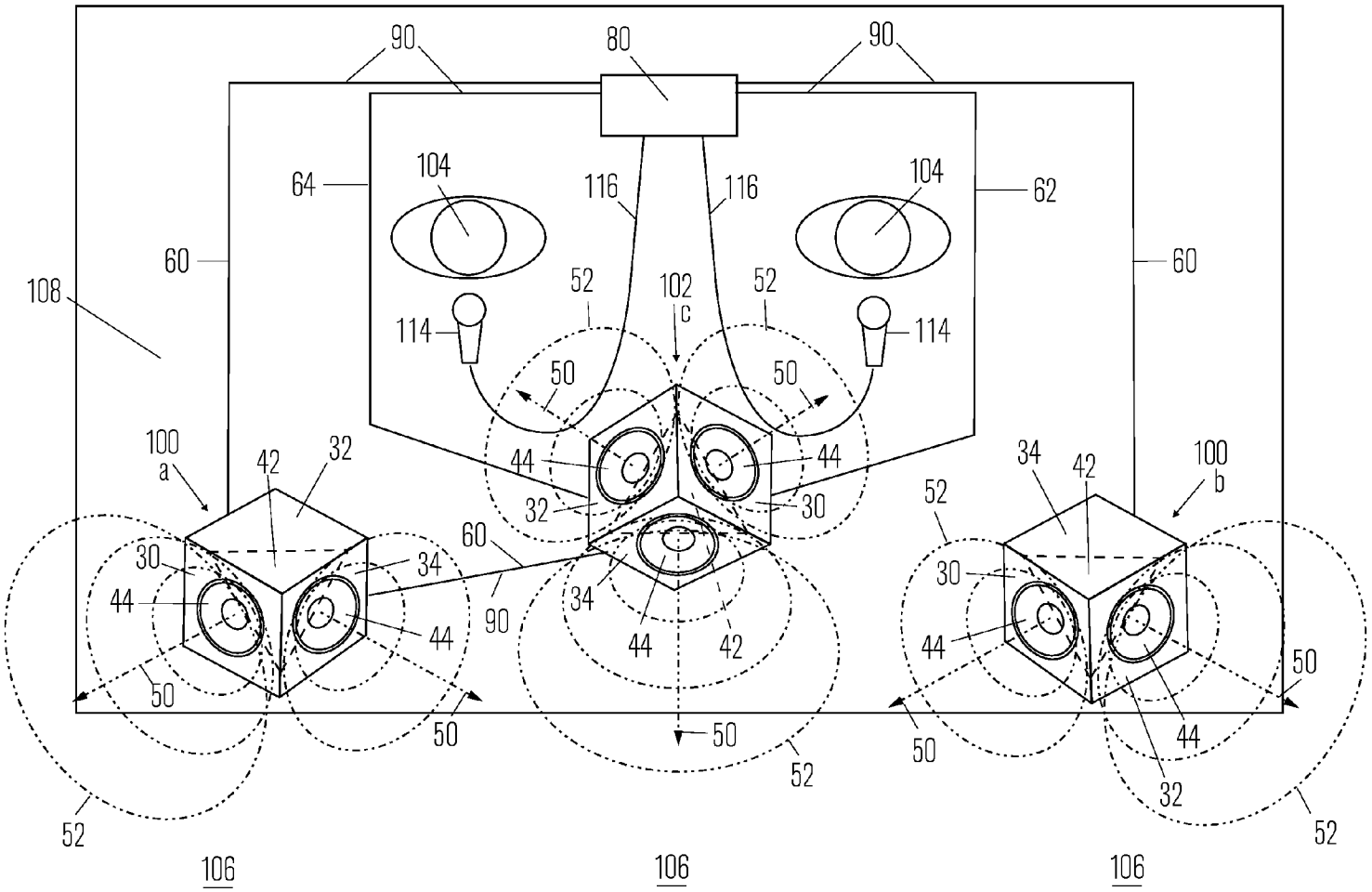
FIG. 25 is an overhead view diagram of a performance setup using a plurality of the first embodiment enclosures as wide dispersion main speakers and a second embodiment enclosure as a double monitor and main speaker.

FIG. 24-25—Operation of Second Embodiment

In order to better understand the novelty and usefulness of this embodiment of the enclosure, describing its use in several situations may be helpful. Shown are only examples of possible uses and are not intended to restrict uses of the enclosure, as many combinations of enclosure embodiments, devices for sound reproduction, audio signal number and combinations, and stage layouts are possible. A professional working in the field of stage or theatrical sound will understand and appreciate the novelty and many advantages of this enclosure over conventional speaker enclosures.

FIG. 24 is a top view diagram of a stage where multiple performers using a single enclosure hear themselves through a floor monitor and have the audience also hear their performance. What is shown is a stage (108), an audience area (106), multiple performers (104), microphones (114), a common audio amplifier (80), cables (116) connecting the microphones (114) to the amplifier (80), an audio signal cable or a plurality of cables (90) connecting the amplifier (80) to the second embodiment enclosure (102) resting on its primary base (42) thereby presenting the loudspeakers (44) on the first panel (30), second panel (32) and third panel (34) at upward angles and directions (50).

Performers (104) vocalize into microphones (114) which are connected by audio cables (116) to an audio amplifier (80) which amplifies the audio signals from the microphones (114) and transfers them through audio cables (90) to a loudspeaker (44) or other device for sound reproduction.

A first audio signal (60) is replicated by the loudspeakers (44) on the first panel (30). A second audio signal (62) is transferred from the amplifier (80) to the enclosure (102) and is directed to the loudspeaker (44) on the second panel (32). A third audio signal (64) is directed to the loudspeaker (44) on the third panel (34).

The dispersion cone of sound (52) can be wide or narrow depending on the specific loudspeakers (44) used. The enclosure allows for different loudspeakers (44) or other devices of sound reproduction to be employed and used on different panels. For instance, narrower frequency loudspeakers can be used for panels used for monitors and a full-range frequency loudspeaker can be used for an audience-facing main speaker.

The described first and second embodiments can also work together in a variety of stage situations. A single example is provided in FIG. 25.

FIG. 25 is a top view diagram of a stage where multiple performers using a plurality of enclosures hear themselves through a floor monitor and have the audience also hear their performance. This diagram describes a use of the second embodiment of the enclosure as a floor monitor and an audience-facing main speaker, and a plurality of first embodiment enclosures as audience-facing wide dispersion main speakers. What is shown is a stage (108), an audience area (106), multiple performers (104), microphones (114), a common audio amplifier (80), cables (116) connecting the microphones (114) to the amplifier (80), an audio signal cable or a plurality of cables (90) connecting the amplifier (80) to the second embodiment of the enclosure (102) resting on its primary base (42) thereby presenting the loudspeakers (44) on the first panel (30), second panel (32) and third panel (34) at an upward angle. Also shown are cables (90) connecting the amplifier (80) to a plurality of first embodiment enclosures (100) resting on their primary bases (42) thereby presenting the loudspeakers (44) on the first panel (30) and second panel (32) at an upward angle and direction (50).

Performers (104) vocalize into microphones (114) which are connected by audio cables (116) to an audio amplifier (80) which amplifies the audio signals from the microphones (114) and transfers them through audio cables (90) to a loudspeaker (44) or other sound-producing device.

A first audio signal (60) is transferred from the amplifier (80) to the audience-facing first embodiment enclosures "a" and "b" (100) and directed to the loudspeakers (44) on the first panel (30) and the second panel (32). An audio cable (90) attached to an audio signal output on the audience-facing enclosure "a" (100) connects to an input on the second embodiment enclosure "c" (102) so the loudspeaker on its audience-facing third panel (34) replicates the first audio signal (60) providing sound to the center-stage audience section (106).

A second audio signal (62) is directed to the loudspeakers (44) on the first panel (30) of the performer-facing second embodiment enclosure "c" (102). A third audio signal (64) is directed to the loudspeaker (44) on the second panel (32) of the performer-facing second embodiment enclosure "c" (102).

The dispersion of sound (52) can be wide or narrow depending on the specific loudspeakers (44) used. Volume controls for the loudspeakers (44) on individual panels can be used to increase or decrease sound volume where appropriate.

CONCLUSION, RAMIFICATIONS AND SCOPE

The reader will understand the embodiments of the enclosure as described demonstrate a new and novel enclosure for use with speakers and other devices, especially in regard to the use as double floor monitors and for a combination of floor monitors and main speaker. The versatility of such a simple and inexpensively produced structure should be clear. The enclosure solves several problems other conventional speaker enclosures do not:

- It combines the capabilities of multiple conventional speaker enclosures in a single compact unit.
- It reduces equipment footprint on stage while providing individual audio signals to multiple performers, allowing them to hear their specific performances.
- It has a wide range of flexibility: allowing for a single audio signal to be distributed to all mounted devices for sound reproduction; two independent audio signals for two separate sets of devices for sound reproduction; and three independent audio signals when constructed with three sets of devices for sound reproduction.
- It can be built simply and inexpensively using a wide variety of materials and industry standard construction methods.
- It provides an attractive and unique shape when resting on its primary base.
- It offers a wider possible sound dispersion than most conventional enclosures, allowing for greater audience coverage. Depending on the dispersion cone and mounting methods of the loudspeakers used, the sound dispersion can exceed 180°.

Although the descriptions above contains many specificities, these should not be construed as limiting the scope of the embodiments but as merely providing illustrations of several embodiments. For example, the enclosure, though shown as a single-corner truncated cuboid in its described embodiments, can have other geometries as described in the claims.

What is claimed is:

1. An enclosure suitable for use as a combination multi-directional foldback stage monitor and/or front of house speaker enclosure consisting essentially of:

a. a container having a first panel, a second panel, a third panel, a fourth panel, a fifth panel, a sixth panel and a seventh panel, each panel being substantially flat and having an inside face and an outside face;

b. the combined panels forming a polyhedron with an inside and an outside;

c. the combined panels forming a right prism, parallelepiped, or cuboid substantially truncated on one corner;

d. the first panel, the second panel and the third panel have four edges;

e. the fourth panel, the fifth panel and the sixth panel have five edges;

f. the seventh panel has three edges;

g. the first panel intersects with the second panel on one edge, intersects the third panel on one edge, intersects the fourth panel on one edge, and intersects the fifth panel on one edge;

h. the second panel intersects with the first panel on one edge, intersects the third panel on one edge, intersects the fourth panel on one edge, and intersects the sixth panel on one edge;

i. the third panel intersects the first panel on one edge, intersects the second panel on one edge, intersects the fifth panel on one edge, and intersects the sixth panel on one edge;

j. the fourth panel intersects with the first panel on one edge, intersects the second panel on one edge, intersects the fifth panel on one edge, and intersects the sixth panel on one edge and the seventh panel on one edge;

k. the fifth panel intersects with the first panel on one edge, intersects the third panel on one edge, intersects the fourth panel on one edge, intersects the sixth panel on one edge and intersects the seventh panel on one edge;

l. the sixth panel intersects with the second panel on one edge, intersects the third panel on one edge, intersects the fourth panel on one edge, intersects the fifth panel on one edge, and intersects the seventh panel on one edge;

m. the seventh panel intersects with the fourth panel on one edge, intersects with the fifth panel on one edge and intersects with the sixth panel on one edge;

n. the intersections are anticline, beveled or rounded;

o. the said seventh panel is the container's primary base;

p. the primary base of the enclosure can directly indirectly contact or can be parallel to a horizontal plane, where the first second, third, fourth, fifth, and sixth panels are substantially oblique to said horizontal plane;

q. the fourth panel is the container's secondary base;

r. the secondary base of the enclosure can directly contact, indirectly contact or can be parallel to a horizontal plane, where the first, second, fifth and sixth panel are substantially perpendicular to the horizontal plane, the third panel is substantially parallel to the horizontal plane, and the seventh panel is at an obtuse angle from the horizontal plane;

s. an opening or a plurality of openings on four-sided and five-sided panels for the addition of predetermined panel-mounted devices such as but not limited to loudspeakers, high frequency speakers, port tubes, lights, meters, volume controls, audio input receptacles, audio output receptacles, pole socket mounts, or handles; </u> t. an opening or openings on the primary base for the attachment of panel-mounted devices such as but not limited to a pole socket mount, handles, feet, wheels or mounting bracket;

whereas: the enclosure is a freestanding loudspeaker enclosure where a means for sound reproduction may be directed in a plurality of directions when used with either the primary base or the secondary base in direct contact, indirect contact or parallel to a horizontal plane; the mounted means for sound reproduction are at acute angles to the horizontal plane and capable of directing sound signals at an acute upward angle to the horizontal plane when resting on the primary base; the mounted means of sound reproduction being either perpendicular to or parallel to the horizontal plane and allowing separate sound signals to be sent in a plurality of directions substantially near 90° from each other when resting on the secondary base.

2. An enclosure as set forth in claim 1 wherein:

a. the enclosure encloses devices or materials to affect sound reproduction;

b. the enclosure encloses a baffle, a plurality of baffles or structures intended to affect sound reproduction;

c. the enclosure encloses an audio amplifier or a plurality of audio amplifiers;

d. the enclosure encloses a wireless receiver or a plurality of wireless receivers;

e. the enclosure encloses electrical circuitry.

3. An enclosure as set forth in claim 1 wherein:

a durable fabric, laminate, paint and/or other coating is applied to the exterior to increase physical protection or attractiveness;

b. an acoustically transparent material or other protective covering is applied onto any panel by direct or indirect contact;

c. speaker cabinet accessories are attached to a panel or plurality of panels, said attachments including but not limited to pole sockets; wall/ceiling brackets, corner-caps, protective feet or pads, and handles;

d. a panel or plurality of panels have graphics, logos or indicia.

4. An enclosure as set forth in claim 1 wherein a predetermined means for sound reproduction is attached to the first panel and a predetermined means for sound reproduction is attached the second panel.

5. An enclosure as set forth in claim 4 wherein:

a. the means for sound reproduction on the said panels replicate a single signal from an audio amplifier;

b. the means for sound reproduction on the first panel replicate a first signal from an audio amplifier, the means for sound reproduction on the second panel replicate a second signal from an audio amplifier;

c. the volume of the means for sound reproduction on a panel are controlled by potentiometer, variable resistor, rheostat, L pad or other equivalent device or method;

d. the said volume control for a means of sound reproduction on a panel may be independent of the volume controls for the means of sound reproduction on other panels.

6. An enclosure as set forth in claim 4 wherein: the primary base of the enclosure directly contacts indirectly contacts or is parallel to a horizontal plane, whereby the enclosure acts as a foldback floor monitor with sound being directed in two different directions in an upward oblique angle toward a performer or plurality of performers, or as a front of house wide-field main loudspeaker enclosure with sound being directed at oblique upward angle towards an audience, or as a front of house stereo loudspeaker enclosure with sound being directed at an oblique upward angle towards an audience, or as a front of house loudspeaker enclosure with a first sound being directed at an oblique upward angle towards a first audience section and a second sound being directed in an oblique upward angle towards a second audience section, or acting simultaneously as a front of house loudspeaker enclosure with a first sound being directed at oblique upward angle towards an audience and as a foldback floor monitor a second sound being directed at an oblique upward angle towards a performer or plurality of performers.

7. An enclosure as set forth in claim 4 wherein the primary base of the enclosure directly contacts indirectly contacts or is parallel to a horizontal plane, whereby the enclosure acts as a foldback floor monitor with sound being directed in two different directions in an upward oblique angle toward a performer or plurality of performers, or as a front of house wide-field main loudspeaker enclosure with sound being directed at oblique upward angle towards an audience, or as a front of house stereo loudspeaker enclosure with sound being directed at an oblique upward angle towards an audience, or as a combination front of house loudspeaker enclosure with a first sound being directed at an oblique upward angle towards a first audience section and a second sound being directed in an oblique upward angle towards a second audience section, or acting simultaneously as a front of house loudspeaker enclosure with a first sound being directed at oblique upward angle towards an audience and as a foldback floor monitor with a second sound being directed at an oblique upward angle towards a performer or plurality of performers.

8. An enclosure as set forth in claim 1 wherein a means for sound reproduction is attached to the first panel, a means for sound reproduction is attached to the second panel, and a means for sound reproduction is attached to the third panel.

9. An enclosure as set forth in claim 8 wherein:

a. the means for sound reproduction on the said panels replicate a single signal from an audio amplifier;

b. the means for sound reproduction on the first panel replicate a first signal from an audio amplifier, the means for sound reproduction on the second panel replicate a second signal from an audio amplifier, and the means for sound reproduction on the third panel replicate a third signal from an audio amplifier;

c. the volume of the means for sound reproduction on a panel are controlled by potentiometer, variable resistor, rheostat, L pad or other equivalent device or method;

d. the said volume control for a means of sound reproduction on a panel may be independent of the volume controls for the means of sound reproduction on other panels.

10. An enclosure as set forth in claim 8 whereby:

a. the enclosure acts simultaneously as a foldback floor monitor with sound being directed at an oblique angle upwardly in two directions toward a performer or plurality of performers and as a front of house main loudspeaker with sound being directed at an oblique angle upwardly towards an audience; or as a wide-field front of house main loudspeaker enclosure with sound being directed in an oblique upward angle towards an audience and sound being directed toward a performer or plurality of performers; or as a front of house stereo loudspeaker enclosure with sound being directed in an oblique upward angle towards an audience and as a foldback floor monitor with a monaural sound being directed toward a performer or plurality of performers; or as a front of house main loudspeaker enclosure with a first sound being directed in an oblique upward angle towards a first audience section, a second sound being directed in an oblique upward angle towards a second audience section and as a foldback floor monitor with a third sound being directed toward a performer or plurality of performers.

11. An enclosure as set forth in claim 8 wherein:

a. the secondary base of the enclosure directly contacts, indirectly contacts or is parallel to a horizontal plane;

b. the means for sound reproduction mounted on the third panel may have its volume eliminated or reduced, whereby the enclosure acts as a wide-field front of house main loudspeaker enclosure with sound being directed towards an audience, or as a front of house stereo loudspeaker enclosure with sound being directed towards an audience, or as a front of house main loudspeaker enclosure with a first sound being directed towards a first audience section and a second sound being directed towards a second audience section, or acts simultaneously as a front of house main loudspeaker enclosure with a first sound being directed towards an audience and as a foldback floor stage monitor with a second sound being directed towards a performer or plurality of performers.

12. An enclosure as set forth in claim 4 wherein the secondary base of the enclosure directly contacts, indirectly contacts or is parallel to a horizontal plane, whereby the enclosure acts as a wide-field front of house main loudspeaker enclosure with sound being directed towards an audience, or as a stereo front of house loudspeaker enclosure with sound being directed towards an audience, or as a front of house loudspeaker enclosure with a first sound being directed towards a first audience section and a second sound being directed towards a second audience section, or acts simultaneously as a front of house loudspeaker enclosure with a first sound being directed towards an audience and as a foldback floor monitor with a second sound being directed towards a performer or plurality of performers.

* * * * *